US006671937B1

(12) United States Patent
Tanaka

(10) Patent No.: US 6,671,937 B1
(45) Date of Patent: Jan. 6, 2004

(54) ROTARY CREEL FOR ELECTRONICALLY CONTROLLED SAMPLE WARPER

(75) Inventor: Yoshihiro Tanaka, Kiryu (JP)

(73) Assignee: Suzuki Warper Ltd., Gunma-ken (JP)

( * ) Notice: Subject to any disclaimer, the term of this patent is extended or adjusted under 35 U.S.C. 154(b) by 0 days.

(21) Appl. No.: 09/688,789

(22) Filed: Oct. 17, 2000

Related U.S. Application Data

(62) Division of application No. 09/221,593, filed on Dec. 29, 1998, now Pat. No. 6,173,480.

(30) Foreign Application Priority Data

Feb. 3, 1998 (JP) ..... 10-021834
Nov. 20, 1998 (JP) ..... 10-331203

(51) Int. Cl.[7] ..... B65H 23/18; D02H 9/02
(52) U.S. Cl. ..... 28/190
(58) Field of Search ..... 66/125; 242/131, 242/131.1; 223/106; 28/190, 191, 195, 193, 192, 194, 196

(56) References Cited

U.S. PATENT DOCUMENTS 3,126,695 A * 3/1964 McGill ..... 57/18
3,884,429 A 5/1975 Dow ..... 242/159
3,915,406 A * 10/1975 Rolli et al. ..... 242/131
4,015,637 A 4/1977 Halton et al. ..... 139/11
4,572,458 A * 2/1986 Bluhm et al. ..... 242/131
4,987,931 A * 1/1991 Shaw et al. ..... 139/450
6,233,798 B1 * 5/2001 Bogucki-Land ..... 28/190
6,401,314 B1 * 6/2002 Spring et al. ..... 28/191
6,449,819 B2 * 9/2002 Tanaka et al. ..... 28/190

FOREIGN PATENT DOCUMENTS

DE 44 22 098 A1 1/1996
EP 0 182 209 5/1986
EP 0 375 480 6/1990
EP 196 05 924 A1 8/1997

* cited by examiner

*Primary Examiner*—A. Vanatta
(74) *Attorney, Agent, or Firm*—Arent Fox Kintner Plotkin & Kahn

(57) ABSTRACT

A rotary creel including a base, a spindle shaft rotatably mounted to the base and protruding forward from the base, a plurality of bobbins mounted to a protruded portion of the spindle shaft through bobbin holders; and a guide plate mounted in a distal end portion of the spindle shaft through a guide arm so as to be positioned in front of the bobbins. A yarn return unit is attached to the distal end portion of the spindle shaft through a front holder. The guide arm is attached to the front holder. The guide plate is positioned in front of the yarn return unit. When the spindle shaft is rotated, a plurality of yarns wound around the plurality of bobbins can be rotated and simultaneously supplied through the yarn return unit and the guide plate.

7 Claims, 37 Drawing Sheets

ROTARY CREEL FOR ELECTRONICALLY CONTROLLED SAMPLE WARPER

This is a Division of application Ser. No. 09/221,593, U.S. Pat. No. 6,173,480, filed Dec. 29, 1998. The disclosure of the prior application(s) is hereby incorporated by reference herein in its entirety.

BACKGROUND OF THE INVENTION

1. Field of the Invention

The present invention relates to generally to an electronically controlled sample warper having a plurality of yarn introduction means for winding yarns on a warper drum to automatically exchange yarns and wind the yarns on a warper drum in accordance with a preset pattern data (yarn order), and more particularly to an electronically controlled sample warper which enables a combined use of a fixed creel and a rotary creel, a warping method, and a rotary creel suitable for use in the warper.

2. Description of the Related Art

As a conventionally used electronically controlled sample warper, there is known a structure disclosed, for example, in Japanese Patent Publication No. 64-8736, as illustrated in FIGS. 34–38. This known electronically controlled sample warper W 20 has a hollow shaft 1 (FIG. 34). Driving and driven shafts 2, 3 project centrally from opposite ends of the hollow shaft 1. A small gear 5 fixed to a pulley 4 and a pulley 99 are loosely mounted on the driving shaft 2, while a small gear 7, to which a warn introduction means 6 is fixed, is loosely mounted on the driven shaft 3 at the distal end. While the illustrated example shows only one yarn introduction means 6, two or more yarn introduction means 6 must be disposed for a plural-winding system, later described.

The small gears 5, 7 are associated with each other through small gears 9, 10 disposed at opposite ends of an associating shaft 8 extending through the hollow shaft 1, which small gears 9, 10 are meshed with the corresponding small gears 5, 7. The hollow shaft 1 is cantilevered at the driving shaft 2, and a warper drum A is loosely mounted on the hollow shaft 1 on the driven shaft 3 side.

As illustrated in FIG. 35, the warper drum A is formed of drum frames 13, 14 having an outer periphery of like shape having alternately an arcuate portion 11 and a straight portion 12; a pair of rollers 15 disposed one on the arcuate portion 11 of each of the drum frames 13, 14; and horizontal beams 16 carrying the rollers around which conveyor belts 17 (FIG. 34) are wound. The conveyor belts 17 are moved along a plane formed by the horizontal beams 16.

The conveyer belts 17 are simultaneously driven to a common amount of fine movement by a drive member 21 threadedly engaged with interior screw shafts 20 of planetary gears 19 concurrently rotated by meshing with a sun gear 18 suitably driven from the exterior. The distal end of the yarn introduction means 6 is bent inwardly to provide a yarn introducing member 6' which is disposed adjacent to the front end of the outer periphery of the warper drum A.

Referring again to FIG. 34, B designates a fixed creel for supporting a plurality of bobbins around which different kinds (different color or different twisting) of yarns 22 are wound; 24, a guide plate for guiding yarns 22 drawn out from the bobbins; 25, a tension regulator for regulating the tension of the yarns 22; 26, a dropper ring; 30, a guide rod for the yarns 22; and E, a yarn fastener having a permanent magnet mounted to a base Y for pressing and setting the yarns.

Further in FIG. 34, reference numeral 27 designates a yarn selection guide unit having a plurality of yarn selection guides 27*a*–27*j* (FIG. 38) for selecting and guiding the yarns 22 according to instructions from a program setting unit 78 (FIG. 37). 28 designates a slitted plate which generates pulses in response to the rotation of the pulley 4 to actuate a plurality of rotary solenoids 29 arranged corresponding to the yarn selection guides 27*a*–27*j*. The yarn selection guides 27*a*–27*j* are mounted to their respective associated rotary solenoids 29 such that they are pivotally moved to advance to an operative position (yarn exchange position) when the rotary solenoids 29 are turned on, and they are pivotally moved in the opposite direction to restore to a standby position (yarn accommodating position) when the rotary solenoids 29 are turned off.

Referring next to FIG. 36, reference numerals 33, 34 and 38 designate shedding bars for jointly forming a shed of the yarns 22, where the bars 33, 38 are upper shedding bars, and the remaining bar 34 is a lower shedding bar. 35 and 37 designate cut shedding bars for separating the shedding down yarns into lower-side yarns and upper-side yarns, where one of the bars 35 is a cut shedding up bar, and the other bar 37 is cut shedding down bar. It should be noted that in FIG. 37, the illustration of the upper shedding bar 38 is omitted.

Reference numeral 39 designates a yarn stopper mounted on the dram frame 13 for stopping a yarn immediately under the broken yarn being shedded (FIG. 35). A rewinder C is composed of a skeleton 40, a pair of rollers 41, 42, a zigzag-shaped comb 43, a roller 44 and a beam 45 for a woven fabric (FIGS. 35 and 36).

Referring next to FIG. 34, reference numeral 46 designates a main motor which may be implemented by an invertor motor for enabling, during operation of the warper, acceleration and deceleration, buffer start/stop, jogging operation and an increased winding speed.

Further in FIG. 34, reference numeral 47 designates a main speed change pulley; 58, a V belt wound on and between the main speed change pulley 47 and an auxiliary speed change pulley 48; 49, a counter pulley which is coaxial with the auxiliary speed change pulley 48; and 50, a brake actuating pinion for reciprocatingly moving a rack to bring the rack into and out of engagement with a brake hole (not shown) in a brake drum D, thus controlling the rotational speed of the warper drum A as desired. 57 designates a V belt between the pulleys 4 on the driving shaft 2; 51, a belt moving motor (AC servo motor); 52, a shift lever; 54 a sprocket-wheel; 55, a chain; 56, a chain wheel for driving the sun gear 18; 57, 58, both V belts; 59, a yarn introduction cover; and D, the brake drum.

Reference numerals 67*a*, 67*b* designate sensors for detecting the passing of the slit of the slitted plate 28.

The slitted plate 28 is set to rotate synchronously with the yarn introduction means 6, so that the rotation of the yarn introduction means 6 is also sensed by the sensors 67*a*, 67*b* by detecting the rotation of the slit of the slitted plate 28. These sensors 67*a*, 67*b* actually comprise three sensors which are arranged at an angular space of about 120 (only two of them are illustrated in the figure).

Referring next to FIG. 37, reference numeral 69 designates a movement/stopping change-over lever for the conveyor belt 17; 70, a locking lever for locking the warper drum A; 74, a shedding bar adjusting lever; 75, a shedding bar locking handle; 78, a program setting unit; 79, a controller; 80, a yarn tensioning unit located centrally on the straight part 12 of the warper drum A; and S, a stopper plate disposed on the base Y corresponding to the yarn selection guide unit 27.

The foregoing electronically controlled sample warper, which has been developed by the present applicant, is favorably accepted as being capable of automatic pattern warping through electronic control.

However, since the conventional electronically controlled sample warper as described above employs an ordinary general-purpose motor as a main motor, there are still several problems to solve. First, it is impossible to increase and/or decrease the rotating speed during operation. Miscatching and mischanging inevitably occur during exchange of yarns. Yarns are susceptible to breakage. In addition, the conventional electronically controlled sample warper is not capable of performing buffer start/stop, jogging operation and so on, so that there have been room for improvement in terms of operation efficiency.

In addition, with respect to a warp density setting method and a mechanism employed thereby, a moving speed of conveyor belts is determined by changing a gear ratio of a transmission connected to a main motor with a warp density setting dial, and the conveyor belts operate even during idling, so that yarns cannot be regularly wound on a warp drum, causing minute changes in tension and warping length during winding.

The present applicant has also developed and proposed electronically controlled sample warpers which employ an invertor motor and an AC servo motor in order to eliminate the inconveniences mentioned above (Japanese Patent Publication Nos. 64-10609 and 64-10610). In the respective proposed warpers, the respective electronically controlled sample warper is provided with a fixed creel for supporting a plurality of bobbins around which different kinds of yarns (yarns of different colors or differently twisted yarns).

The present applicant has also developed and proposed an electronically controlled sample warper which is capable of simultaneously warping a plurality of yarns (Japanese Patent Publication No. 4-57776). This electronically controlled sample warper eliminates the need for a yarn exchange process to suppress time loss for yarn exchange to zero. In addition, since a plurality of yarns can be simultaneously wound on a warper drum, a warping operation time can also be reduced.

In this electronically controlled sample warper capable of simultaneously warping a plurality of yarns, since a plurality of yarn introduction means are disposed, a conventional fixed creel cannot support it. For this reason, a rotary creel has been developed, together with the development of the electronically controlled sample warper capable of simultaneously warping a plurality of yarns, for simultaneously warping a plurality of yarns. The development of this rotary creel enables a plurality of yarns to be simultaneously warped, consequently realizing a reduction in a warping time.

The rotary creel is rotated in synchronism with the rotation of the plurality of yarn introduction means. A synchronous operation mechanism will be described below with reference to FIGS. 39–41. FIG. 39 is a diagram schematically showing how an encoder is mounted in the conventional electronically controlled sample warper, FIG. 40 is a schematic lateral cross-sectional view of the conventional rotary creel, and FIG. 41 is a block diagram illustrating the operation principles of the conventional rotary creel.

Referring first to FIG. 39, a pulley 98 is associated with the pulley 99 illustrated in FIG. 34 by a timing belt. An encoder 97 is mounted on an extension of a shaft on which the pulley 98 is fixed.

Referring next to FIG. 40, a rotary creel F supports two or more bobbins 126 around which the same kinds of yarns (yarns of the same color or identically twisted yarns) and/or different kinds of yarns (yarns of different colors or differently twisted yarns) are wound, respectively. Reference numeral 300 designates an encoder for detecting the rotation of the rotary creel F; 301, a motor with a reducer; 302, a timing pulley fixed to an output shaft 308 of the reducer; and 303, a timing pulley fixed to a rotary shaft 307 and operatively connected with a timing belt 309. Reference numeral 304 designates a tension regulator for regulating the tension of the yarns 22; and 310, a limit switch for sensing any possible yarn breakage.

This rotary creel F can operate in synchronism with yarn introduction members 6' while constantly comparing rotational signals between the above-mentioned encoder 97 and the encoder 300 on the rotary creel F. The position of the bobbins 126 to be supported on the rotary creel F must be relatively coincident with the yarn introduction members 6'.

Referring next to FIG. 41, an operating switch assembly 311 is composed of four switches for warping on, warping off, fine movement in forward rotation, and fine movement in reverse rotation, respectively. Of signals from such four switch, switching signals for warping on and warping off are transmitted to the electronically controlled sample warper W, while switch signals for fine movement in forward rotation and fine movement in reverse rotation are transmitted to a synchronous operation control unit 312 to locate the yarn introduction members 6' and the bobbins 126, on which the yarns 22 to be caught by the yarn introduction members 6' are wound, in register with one another.

In the synchronous operation control unit 112, a RUN signal (warping-on signal) and a JOG signal (jogging operation signal), which are transmitted from the electronically controlled sample warper W, and the above-mentioned fine-movement-in-forward-rotation signal and fine-movement-in-reverse-rotation signal are converted into ENB signals (synchronous operation enable signal) to be transmitted to a synchronous operation card 314. Further, FWD (forward rotation), REV (reverse rotation), JOG (jogging operation) signals and so on are transmitted to an invertor 313.

The synchronous operation card 314 is also connected to an encoder 97 mounted in the electronically controlled sample warper W and to the encoder 300 mounted in the rotary creel F. During a warping-on and jogging operation, the rotational angles of the two encoders 97, 300 are constantly compared, and signals are transferred between the synchronous operation card 314 and the invertor 313 so as to keep constant the positional relation between the yarn introduction member 6' and the bobbins 126 around which the yarns 22 to be caught by the yarn introduction members 6' are wound.

The invertor 313 supplies a rotational signal to the motor 301 with a reducer, located in the rotary creel F. The invertor 313 and the synchronous operation card 314 may be implemented by those available on the market.

The present applicant has also proposed an electronically controlled sample warper capable of aligned winding, wherein after a first column of yarns has been wound on a warper drum, the next column of yarns is wound such that the beginning of the yarns of the next column are positioned in front of the yarns of the first column, thereby making it possible to achieve aligned winding warping in order from the lower yarns on the warper drum, and to facilitate winding of yarns to a weaving beam even if a warping length is longer (Japanese Patent Laid-open Publication No.

7-133538). Likewise, this improved version of the electronically controlled sample warper has been highly favorably accepted.

Creels for use in electronically controlled sample warpers may be classified into two: a fixed creel and a rotary creel, as mentioned above.

The fixed creel has a plurality of bobbins around which the same kind and/or different kinds of yarns (mainly different kinds of yarns) are wound, and is capable of warping yarns one by one. Therefore, the fixed creel has an advantage of providing a warping operation for pattern warping. However, since yarns are wound one by one sequentially around a warping drum, the fixed creel has a disadvantage of taking a longer warping operation time. The rotary creel, on the other hand, has a plurality of bobbins around which the same kinds and/or different kinds of yarns are wound, and is usable in warping of extremely limited patterns such as plain warp (for example, only a red yarn), one-to-one (for example, repetitions of a red yarn and a white yarn, or a S-twisted yarn and a Z-twisted yarn), two-to-two (for example, repetitions of two red yarns and two white yarns, or two S-twisted yarns and two Z-twisted yarns), and so on. While this rotary creel has a disadvantage of inability to perform a warping operation for pattern warping other than limited pattern warping, it is has an advantage of largely reducing a warping time because of simultaneous windings of a plurality of yarns around a warper drum.

For example, when warping L (FIG. 32) of vertical yarns is performed for weaving a cross-striped fabric M, as illustrated in FIG. 31, it is advantageous, from a viewpoint of warping time, to perform plain warping by use of a rotary creel, because the pattern includes a considerable amount of plain portion. However, since the cross-striped fabric M includes stripe portions with yarns of different colors, the use of a rotary creel is impossible, so that a fixed creel must be inevitably used. When a fixed creel is used, yarns are wound one by one around a warper drum even for plain warp portions, a warping time is required for each yarn, so that correspondingly inefficient operation must be done as a warping operation without any alternative.

SUMMARY OF THE INVENTION

The present invention has been made in view of the problems inherent to the above-mentioned prior art, and it is an object of the present invention to provide an electronically controlled sample warper which is capable of extremely efficiently performing a warping operation involving plain warping and pattern warping in a reduced warping time.

To solve the problem s mentioned above, the present invention provides an electronically controlled sample warper for automatically exchanging yarns and winding the yarns on a warper drum in accordance with a preset yarn order. The electronically controlled sample warper is characterized by comprising a plurality of yarn introduction means each rotatably mounted to a side surface of the warper drum for winding a yarn on the warper drum, a yarn introduction member arranged at a distal end of each of the yarn introduction means for holding a yarn, a plurality of yarn selection guides, arranged in one end portion of a base for supporting the warper drum in correspondence to the yarn introduction means, wherein each of the yarn selection guides is pivotally moved to protrude to a yarn exchange position when a yarn is exchanged and pivotally moved to retract to a standby position when a yarn is accommodated, and yarns are passed between the yarn introduction means and the yarn selection guides, a fixed creel installed corresponding to the plurality of yarn selection guides for supporting a plurality of bobbins around which different kinds of yarns are wound, and a rotary creel installed corresponding to the plurality of yarn selection guides for supporting a plurality of bobbins around which different kinds and/or the same kind of yarns are wound.

Both the yarns in the fixed creel and the yarns in the rotary creel are accommodated in corresponding yarn selection guides, so that the yarns in the fixed creel and the yarns in the rotary creel can be used in combination in accordance with preset pattern data to wind the yarns on the warper drum to perform pattern warping.

When a warping operation is started, it is determined whether the fixed creel or the rotary creel is used in accordance with preset pattern data, and the fixed creel or the rotary creel can be selectively used in alternation in accordance with the pattern data.

Preferably, a controller is newly provided with a creel selection control function which determines whether the rotary creel or the fixed creel is used, when warping conditions (inputting of a pattern, a warping width, the number of yarns for warping, a warping length) are inputted, so that yarns of both the rotary creel and the fixed creel can automatically be used in combination.

It is preferable to enable selection of accommodation and supply of yarns in the rotary creel by the yarn selection guides, in addition to enabling selection of accommodation and supply of yarns in the fixed creel by the yarn selection guides.

Of course, it is necessary to provide a number of the yarn selection guides equal to the sum of the number of yarns supported by the fixed creel (the number of bobbins) and the number of yarns supported by the rotary creel (the number of bobbins).

When the rotary creel is used, a plurality of yarns can be simultaneously warped, and when the rotary creel is used to simultaneously warp two or more yarns, the rotary creel is rotated in synchronism with the rotation of the plurality of yarn introduction means, and yarns can be passed by yarn selection guides corresponding to the yarn introduction members and the rotary creel.

When a plurality of yarns are simultaneously warped using the rotary creel, the rotary creel must be rotated in synchronism with the rotation of the yarn introduction means. Also, when the rotary creel is not rotated, yarns on the rotary creel can be exchanged one by one, as is the case of the fixed creel.

When the rotary creel is used to warp a single yarn, the rotary creel is used in an inoperative state when a single yarn introduction means on the rotary creel is only used for warping.

During a synchronous operation of the rotary creel and when the rotary creel is not rotated, yarns on the rotary creel can be orderly selected to the yarn introduction means, and also freely selected as long as the yarns do not get twisted (such as a rope).

Preferably, a yarn draw-back unit may be attached to a distal end of the rotary creel in order to reduce a time required to accommodate yarns on the rotary creel.

When the fixed creel is used to warp a single yarn, one of the plurality of yarn introduction members is used such that the yarn is passed by a yarn selection guide corresponding to preset pattern data.

Preferably, the yarn introduction member is movably mounted to the distal end of each of the yarn introduction means. In this case, when a yarn is passed from the yarn introduction member to a yarn selection guide, the yarn introduction member is moved in a direction in which the yarn is removed to remove the yarn from the yarn introduction member, and the removed yarn is held by the yarn selection guide. When a yarn is passed from a yarn selection guide to the yarn introduction member, the yarn introduction member is moved in a direction in which the yarn is held to hold the yarn held in the yarn selection guide in the yarn introduction member to exchange yarns.

The yarn introduction member may be rotatably mounted to the distal end of the yarn introduction means. In this case, the yarn introduction member is rotated in a direction in which a yarn is removed to remove the yarn from the yarn introduction member, and the yarn introduction member is rotated in a direction in which the yarn is held to hold the yarn in the yarn introduction member to exchange yarns.

The yarn introduction member may be movably mounted to the distal end of the yarn introduction means through a yarn introduction plate, and yarns can be exchanged using the yarn introduction member thus constructed.

The yarn introduction member may also be mounted to the distal end of the yarn introduction plate for protruding and retracting movements, where the yarn introduction member is accommodated into the yarn introduction plate to remove a yarn from the yarn introduction member, and the yarn introduction member is protruded from the yarn introduction plate to hold a yarn in the yarn introduction member to exchange yarns.

The yarn introduction member may be pivotably mounted to the distal end of the yarn introduction plate, wherein the yarn introduction member is pivotally moved in a direction in which the yarn introduction member is accommodated in the yarn introduction plate to remove a yarn from the yarn introduction member, and the yarn introduction member is pivotally moved in a direction in which the yarn introduction member protrudes from the yarn introduction plate to hold a yarn in the yarn introduction member to exchange yarns.

A yarn removing member, linearly movable in a vertical direction, may be arranged near each yarn selection guide for protruding and retracting movements. In this case, when a yarn is passed from the yarn introduction member to the yarn selection guide, the yarn removing member is protruded to remove the yarn from the yarn introduction member, and the removed yarn is held by the yarn selection guide. When a yarn is passed from the yarn selection guide to the yarn introduction member, the yarn removing member is retracted to hold the yarn held in the yarn selection guide in the yarn introduction means to exchange yarns.

Preferably, the yarn introduction member may be actuated by a plurality of yarn introduction member actuator units. The plurality of yarn introduction member actuator units may be arranged on an end surface of the warper drum or on a yarn introduction cover positioned on the end surface of the warper drum, and the plurality of yarn introduction member actuator units are operated to actuate the yarn introduction members in accordance with a preset yarn exchange order.

A plurality of yarn introduction member detecting sensors may be arranged on the end surface of the warper drum or on the yarn introduction cover positioned on the end surface of the warper drum. Desired warping can be automatically achieved when the yarn introduction member actuator units are operated in response to a yarn introduction means detecting signal from the sensors in accordance with the preset yarn exchange order.

A plurality of yarn introduction member detecting sensors may be arranged on the end surface of the warper drum or on the yarn introduction cover positioned on the end surface of the warper drum, such that the yarn introduction members are actuated in response to a yarn introduction means detecting signal from the sensors in accordance with the preset yarn exchange order. The warping can also be performed using this structure.

A warping method according to the present invention uses an electronically controlled sample warper comprising a fixed creel and a rotary creel, and is characterized by selecting the fixed creel or the rotary creel in accordance with preset pattern data, using the fixed creel to perform pattern warping with a single yarn for complicated pattern warping, and using the rotary creel to perform simultaneous plural yarn warping with two or more yarns for plain warping or simple pattern warping.

The above-mentioned rotary creel preferably comprises a base, a spindle shaft rotatably mounted to the base and protruding forward from the base, a plurality of bobbins mounted to a protruded portion of the spindle shaft through bobbin holders, and a guide plate mounted in a distal end portion of the spindle shaft through a guide arm so as to be positioned in front of the bobbins, wherein the spindle shaft is rotated so that a plurality of yarns wound on the plurality of bobbins can be rotated and simultaneously supplied through the guide plate.

More preferably, the rotary creel comprises a yarn return unit attached to a distal end portion of the spindle shaft through a front holder, wherein the guide arm is attached to the front holder, and the guide plate is positioned in front of the yarn return unit, so that a plurality of yarns wound on the plurality of bobbins can be rotated and simultaneously supplied through the yarn return unit and the guide plate.

Most preferably, the rotary creel comprises a yarn retainer attached to the front holder, and a guide plate and the yarn return unit are positioned in front of the yarn retainer, so that a plurality of yarns wound on the plurality of bobbins can be rotated and simultaneously supplied through the yarn retainer, the yarn return unit and the guide plate.

Preferably, the yarn return unit is capable of applying tensile force to the yarn in warping, putting back toward the rotary creel the yarn loosened when yarn exchanging and applying force to the yarn accommodated in the yarn selection guide so as to always keep the yarn in a state of tension.

Preferably, the yarn return unit may include a frame having a hollow interior, one or a plurality of yarn passing bars traversing the hollow interior in a front half portion of the frame, a swing arm having a base end mounted to a rear half portion of the frame, and always urged upwardly so as to be swingable in a vertical direction about the base, and one or a plurality of yarn pass rings formed on a free end portion of the swing arm.

More preferably, upward urging force applied to the yarn return unit is adjustable.

DESCRIPTION OF THE PREFERRED EMBODIMENTS

Figure 1:
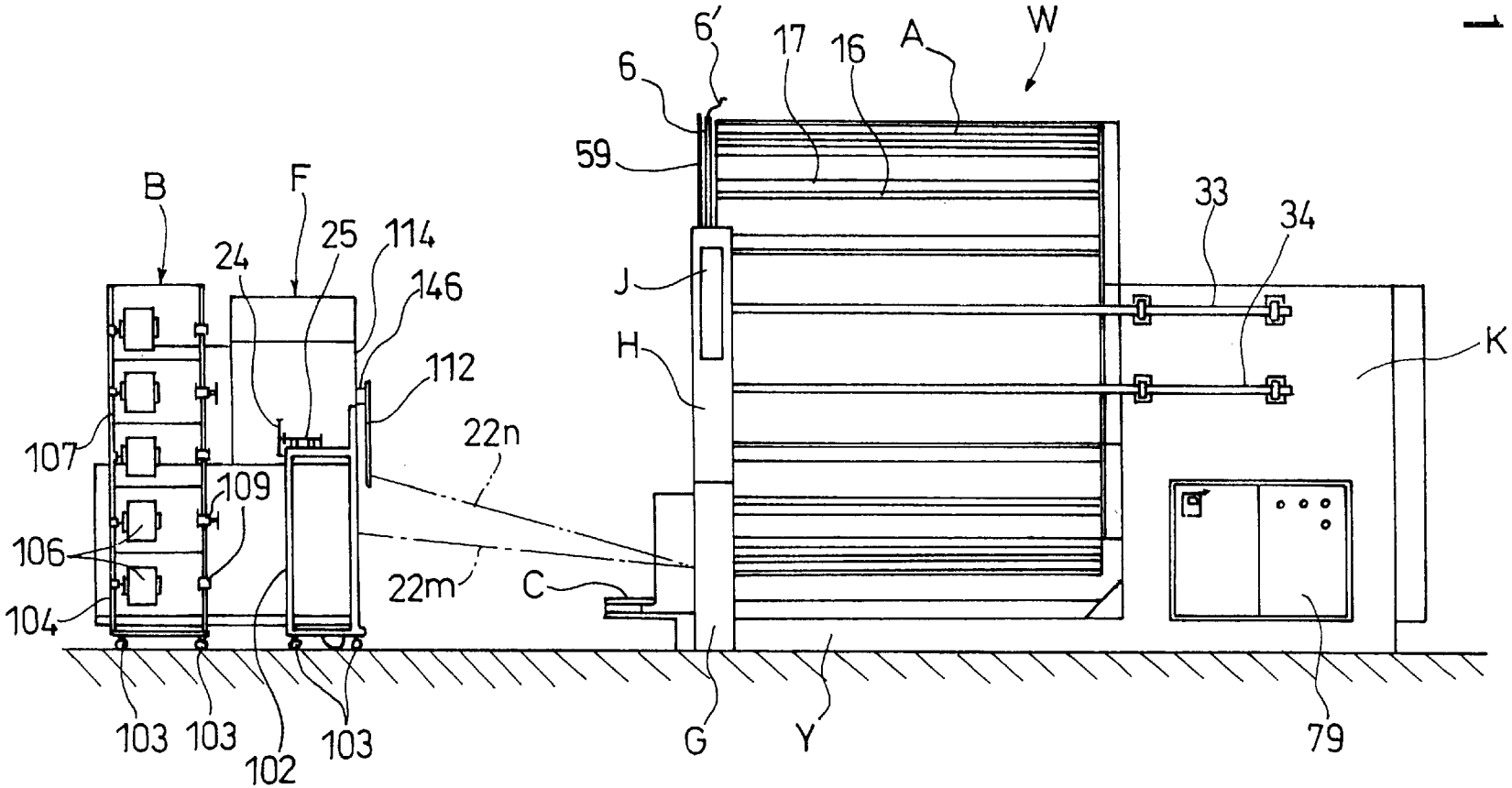
FIG. 1 is a schematic lateral view of an electronically controlled sample warper according to the present invention.
Figure 2:
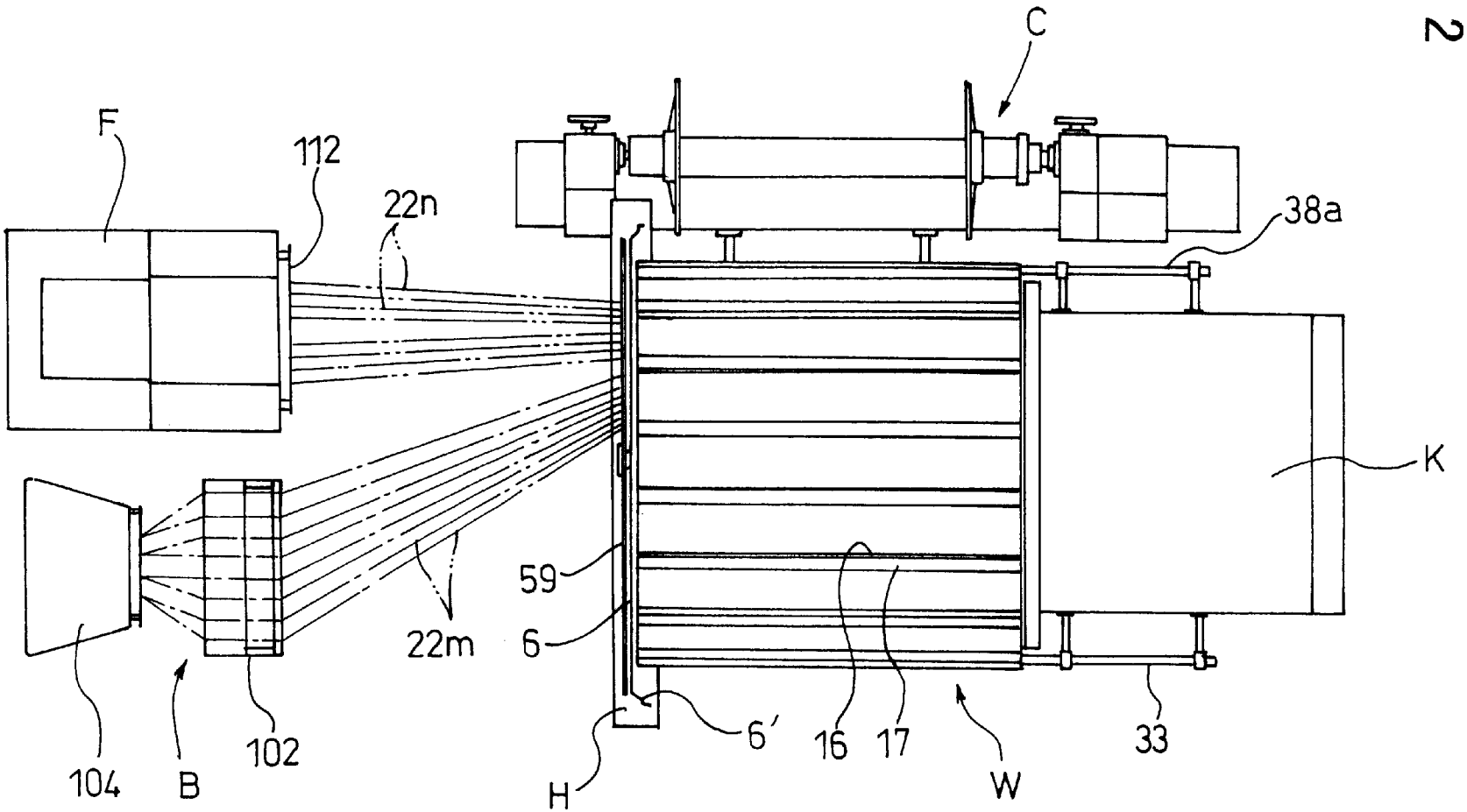
FIG. 2 is a schematic top plan view of the electronically controlled sample warper illustrated in FIG. 1.
Figure 3:
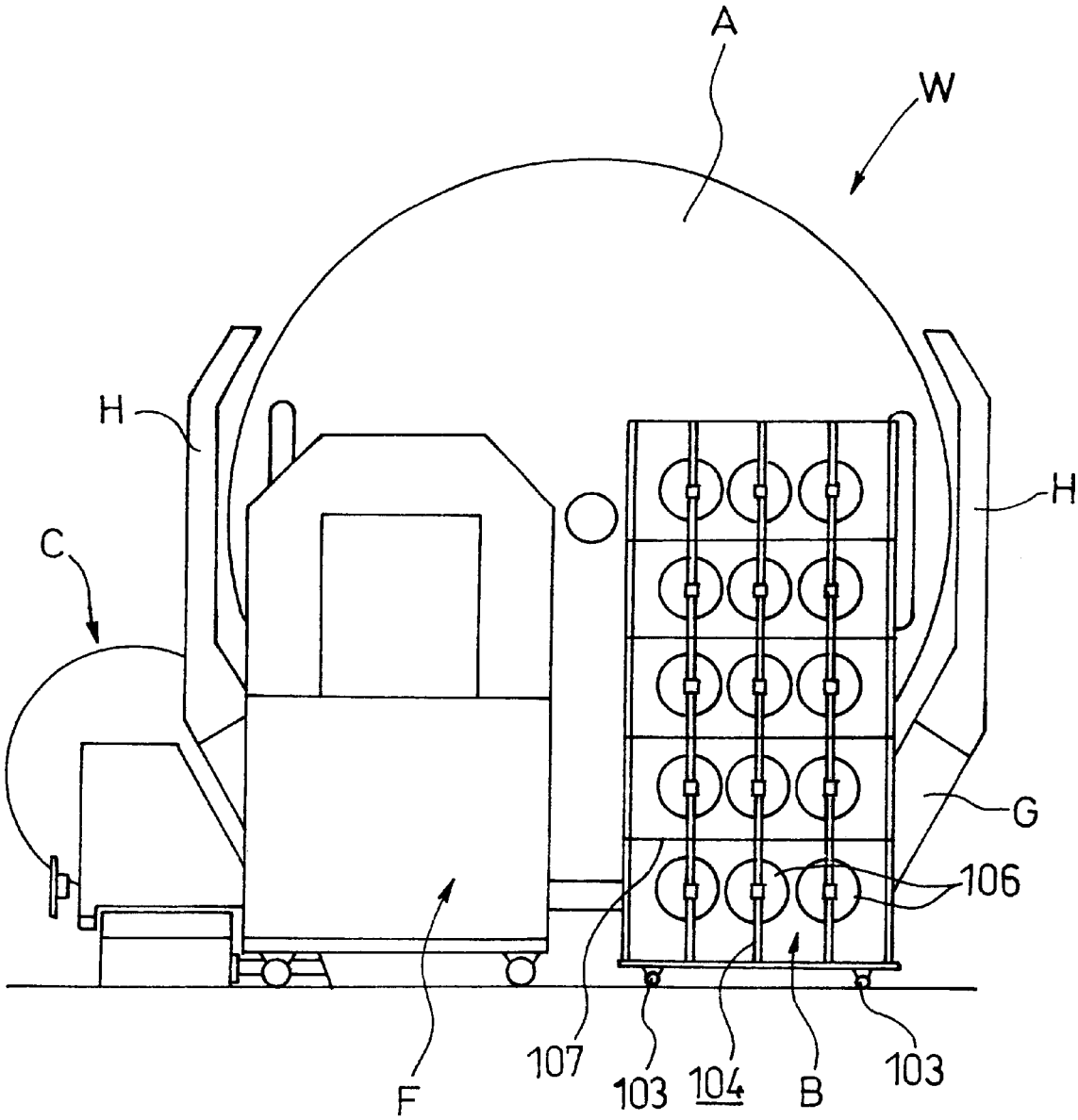
FIG. 3 is a schematic front view of the electronically controlled sample warper illustrated in FIG. 1 including a fixed creel and a rotary creel viewed from a rear side.
Figure 4:
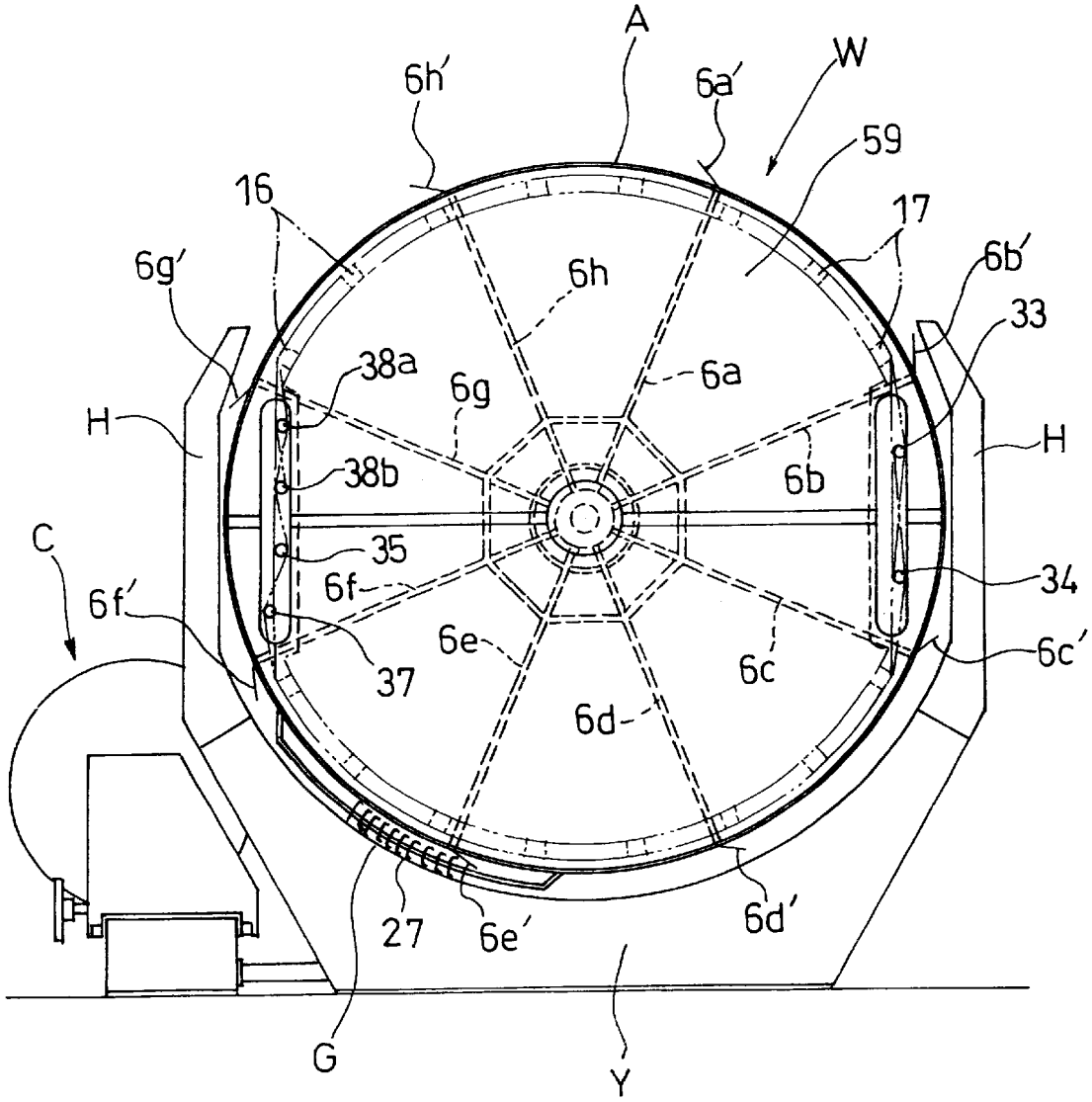
FIG. 4 is a schematic front view illustrating the electronically controlled sample warper and a repeater.

The present invention will hereinafter be described in connection with several embodiments with reference to FIGS. 1–33, where members identical or similar to those in the prior art warper illustrated in FIGS. 34–41 are designated the same reference numerals.

Referring first to FIG. 1, an electronically controlled sample warper W according to the present invention basically has a similar structure and performs similar operations to the prior art electronically controlled sample warper illustrated in FIGS. 34–41, except for characteristic features and operations of the present invention, later described.

Specifically, while the illustrated embodiment of the present invention differs from the aforementioned prior art apparatus in the structure of the rewinder C, positioning of the shed bars 33, 34, 38 and the cut shed bars 35, 37, removal of the stopper plate S, and so on, the basic structure and operations of the electronically controlled sample warper W itself are not changed, so that repetitive detailed explanation thereof is omitted. It should be noted that while a controller 79 illustrated in FIG. 1 is provided with a program setting unit similar to that shown in FIG. 24, the illustration of the program setting unit is omitted due to an inconvenience which would be caused by the inclusion of the program setting unit in the illustration. Also, the controller 79 illustrated in FIG. 1 differs from the conventional controller in that a creel selection control unit is included for selecting a fixed creel B or a rotary creel F.

As illustrated, the electronically controlled sample warper W of the present invention comprises a plurality of yarn introduction means 6 rotatably mounted to a side surface of a warper drum A for winding yarns 22 around the warper drum A, and a plurality of yarn selection guides 27*a*–27*j*, mounted at one end portion of a base Y for supporting the warper drum A, corresponding to the respective yarn introduction means 6 such that they are pivotally moved to protrude to a yarn exchange position when yarns are exchanged and pivotally moved to retract to a standby position when yarns are accommodated, in a manner similar to the aforementioned prior art warper. The electronically controlled sample warper W passes the yarns between the yarn introduction means 6 and the yarn selection guides 27*a*–27*j* to pivotally pass the yarns 22 in accordance with a preset yarn order to wind the yarns 22 on the warper drum A.

In FIG. 1, the electronically controlled sample warper W further comprises a yarn exchange unit G, a side cover H, a viewing window J, and a motor section K.

As is well illustrated in FIGS. 1–4, in the electronically controlled sample warper of the present invention, a fixed creel B for supporting a plurality of bobbins 106 around which different kinds of yarns (yarns of different colors or differently twisted yarns) and/or the same kind of yarns (yarns of the same color or identically twisted yarns) are wound, and a rotary creel F for supporting a plurality of bobbins 126 (FIG. 11) around which different kinds of yarns and/or the same kind of yarns are wound, are installed in a positional relationship with the plurality of yarn selection guides 27*a*–27*j*. The fixed creel B usually supports a plurality of bobbins 106 around which different kinds of yarns are wound.

Yarns 22*m* in the fixed creel B and yarns 22*n* in the rotary creel F are accommodated in the plurality of yarn selection guides 27*a*–27*j*, respectively, in such a manner that the yarns 22*m* in the fixed creel B and the yarns 22*n* in the rotary creel F may be used in combination, and the yarns 22*m* in the fixed creel B and the yarns 22*n* in the rotary creel F may be sequentially wound on the warper drum A as required.

The fixed creel B includes a creel stand 102 and a bobbin stand 104. The bobbin stand 104 has a bobbin frame 107 including casters 103 secured on the bottom surface thereof. An appropriate number of bobbins 106 are mounted on the rear end side of the bobbin frame 107. A first guide plate 109 is attached at a position in front of each of the bobbins 106.

Figure 5:
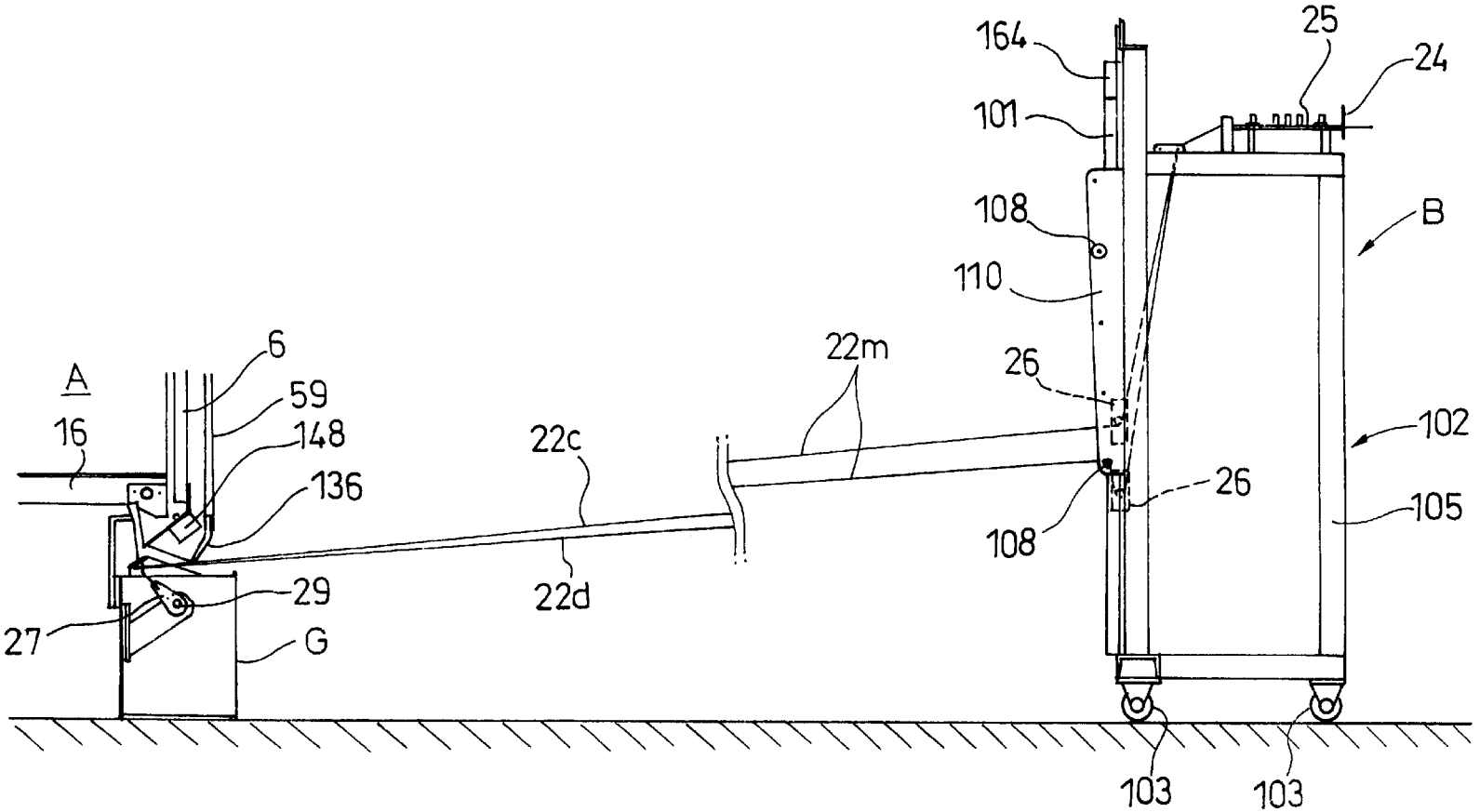
FIG. 5 is a lateral view of the electronically controlled sample warper illustrated in FIG. 1 for showing the positional relationship between the fixed creel and a yarn selection guide unit when the fixed creel is used for warping.

The creel stand 102 has a base frame 105 including casters 103 secured on the bottom surface thereof (FIG. 5). A tension regulator 25 is mounted on the top surface of the base frame 105. A second guide plate 24 is positioned behind the tension regulator 25 in association therewith. Vertical guide rods 101 corresponding in number to the number of mounted drop rings 26 are implanted on a front surface of the base frame 105 for vertically movably supporting the dropper rings 26 each formed with a yarn throughhole 26*a* (FIG. 6) extending through a central portion thereof. A dropper ring frame 164 is mounted to upper ends of the vertical guide rods 101.

Thus, the yarns 22*m* wound around the bobbins 106 are threaded through the yarn throughholes 26*a* of the dropper rings 26 via the first guide plates 109, the second guide plate 24, and the tension regulator 25.

Figure 6:
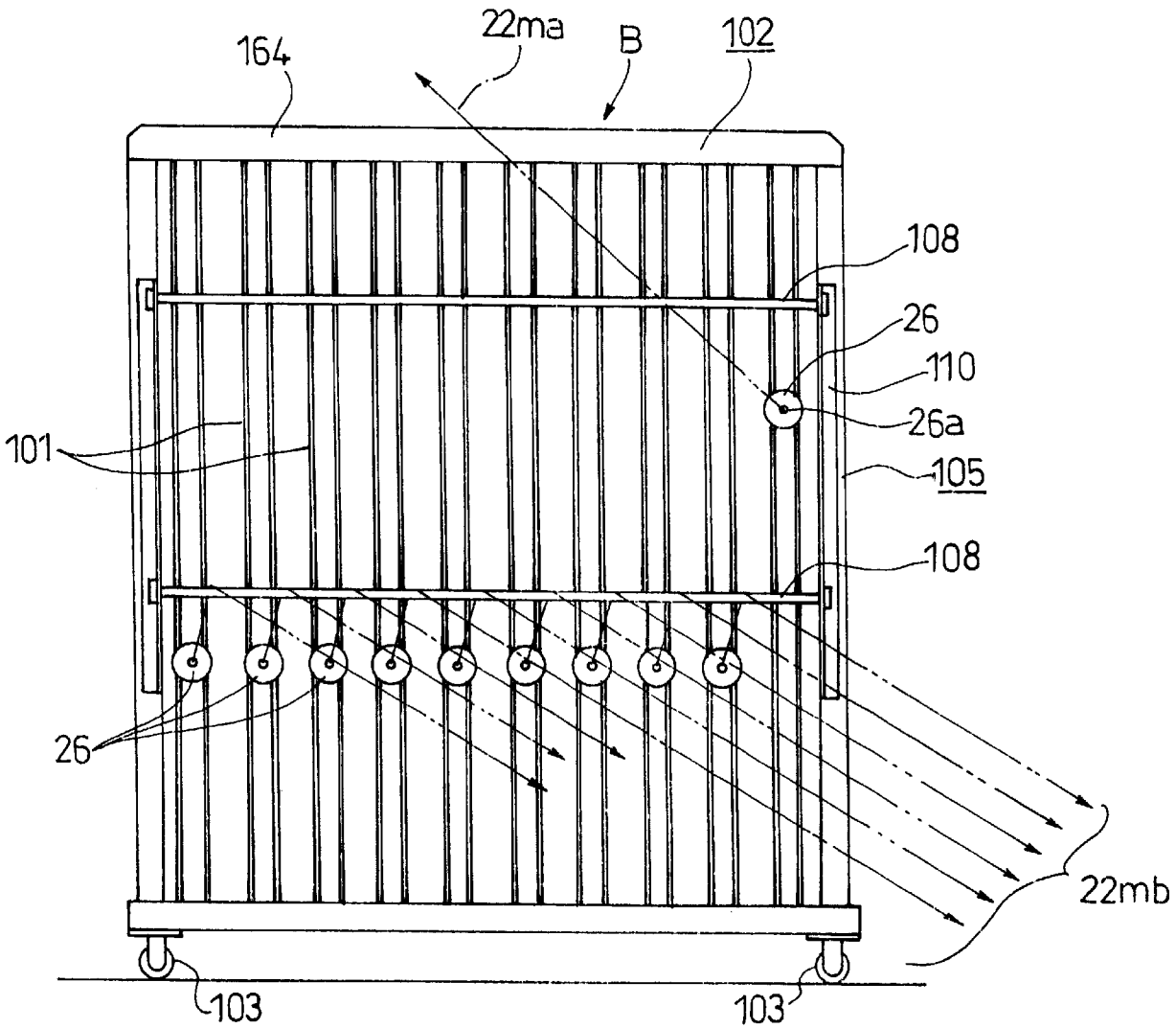
FIG. 6 is a schematic front view of the fixed creel.

Guide rods 108 are set at appropriate positions, in accordance with warping conditions, for guiding the yarns 22. As illustrated in FIG. 6, since yarns 22*ma* during warping have their leading ends wounded on the warper drum A through the yarn introduction means 6, the tension of the yarns varies, causing the dropper rings 26 to vertically move in response to the varying tension. On the other hand, with stationary yarns (yarns accommodated in the yarn selection guide unit 27) 22*mb*, the dropper rings 26 are positioned at lower portions of the guide rods 108, so that the yarns 22*mb* are guided to the yarn selection guide unit 27 through the guide rods 108 and accommodated therein.

When the rotary creel F is used, a plurality of yarns can be simultaneously warped as mentioned above. Also, in this event, the rotation of the rotary creel F and the rotation of the plurality of yarn guiding means 6 are synchronized with each other for synchronous operation, as described above with reference to FIGS. 39–41. Therefore, repetitive explanation is omitted. The rotary creel F in the present invention employs a unique structure which cannot be seen in conventional rotary creels, and is described below.

As illustrated in FIGS. 11–16, the rotary creel F has a base body 129 which is formed of a base plate 130 having casters 132 secured on the bottom surface thereof, and a front frame 134*a* and a rear frame 134*b* standing vertically at front and rear ends of the base plate 130.

Above the frames 134*a*, 134*b*, a spindle shaft 124 is rotatably mounted through front and rear pillow bearings 136*a*, 136*b*. The spindle shaft 124 has its distal end protruding forward from the front frame 134*a*.

A timing pulley 142 is mounted to a protruding portion of the spindle shaft 124 adjacent to the front pillow bearing 136*a*. The timing pulley 142 is coupled to a motor pulley 140 of a motor 138 mounted on the base plate 130 through a timing belt 144, such that the rotation of the motor, when driven, is transmitted to the spindle shaft 124 through the motor pulley 140, the timing belt 144 and the timing pulley 142, causing the spindle shaft 124 to rotate.

A bobbin holder 128 is mounted to the protruding portion of the spindle shaft 124, and a plurality of bobbins 126 (eight in the illustrated example) are attached at leading ends thereof. The bobbins 126 are wound with different kinds and/or same kind of yarns 22*n*. Thus, during a warping operation, the rotation of the spindle shaft 124 enables the plurality of bobbins 126 to rotate in synchronism with the rotation of the yarn introduction means 6 and simultaneously supply the yarns 22*n*.

A front holder 122 is mounted to the distal end of the spindle shaft 124 and has a plurality (eight in the illustrated example) of yarn retainers (generally referred to as accumulators) 120 attached at leading ends thereof.

In front of each of the yarn retainers 120, a yarn return member 118 is arranged adjacent thereto. A guide plate frame 114 is positioned in front of the yarn return member 118 through a guide plate arm 116 arranged on the front surface side of the front holder 122.

A guide plate 112 for collectively guiding the yarns 22*n* is formed of a pair of rotatable plates, and is positioned in front of the front surface of the guide plate frame 114 with a guide plate driving unit 146 interposed therebetween. A yarn breakage sensor 121 is provided for sensing yarn breakage.

Figure 13:
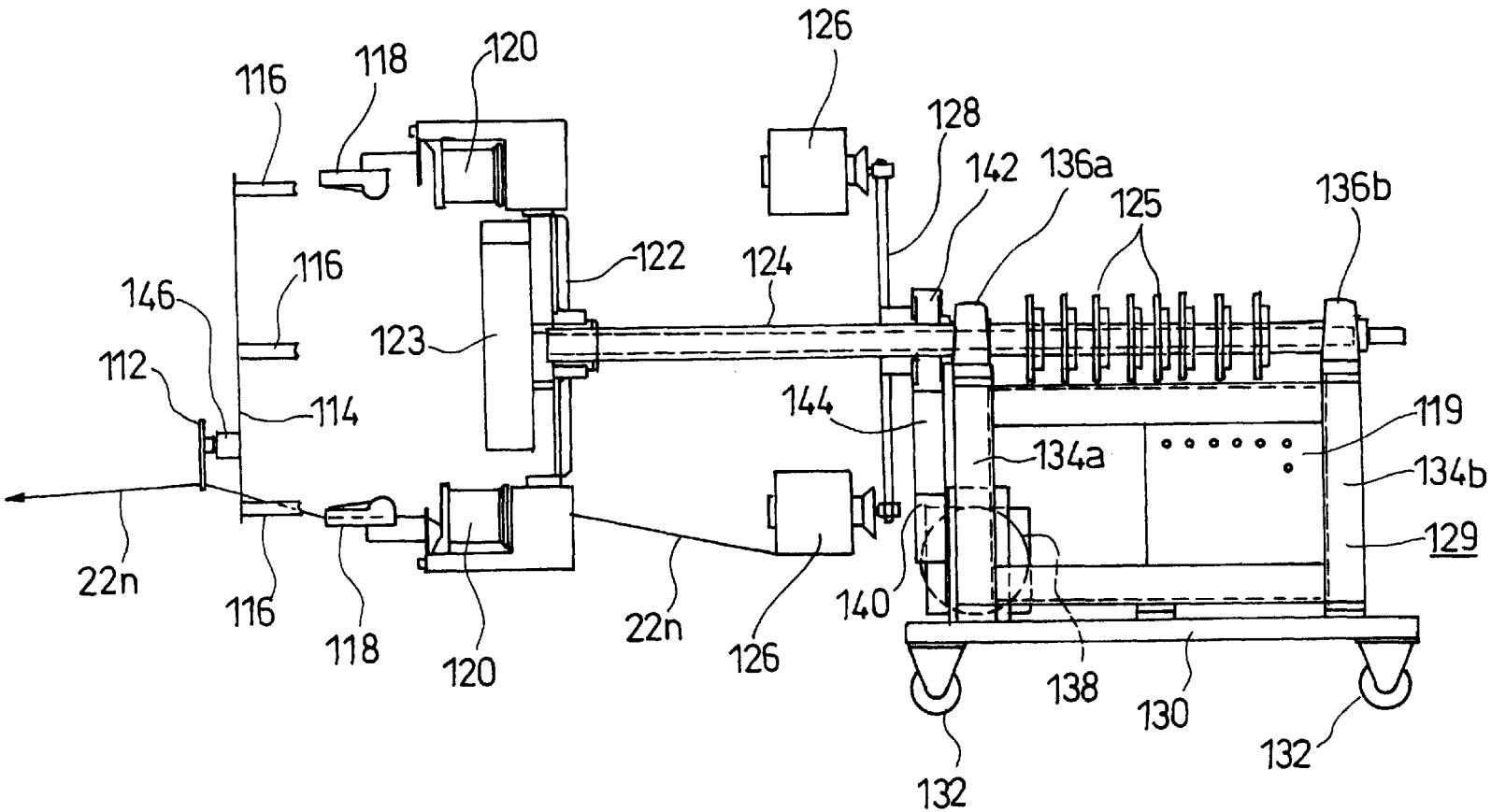
FIG. 13 is an enlarged lateral view of the rotary creel (inoperative state) illustrated in FIG. 11.
Figure 14:
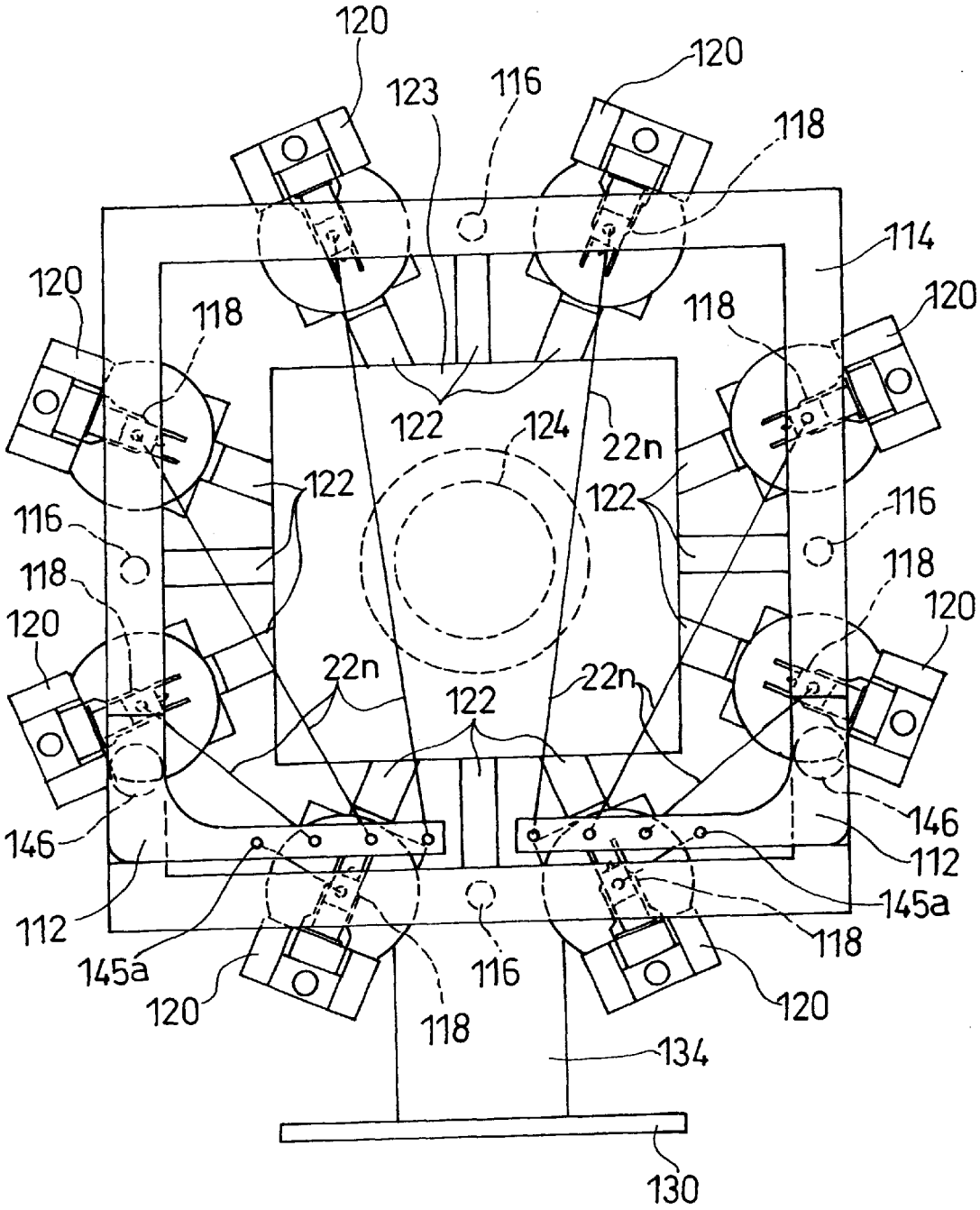
FIG. 14 is a front view of the rotary creel illustrated in FIG. 13.
Figure 15:
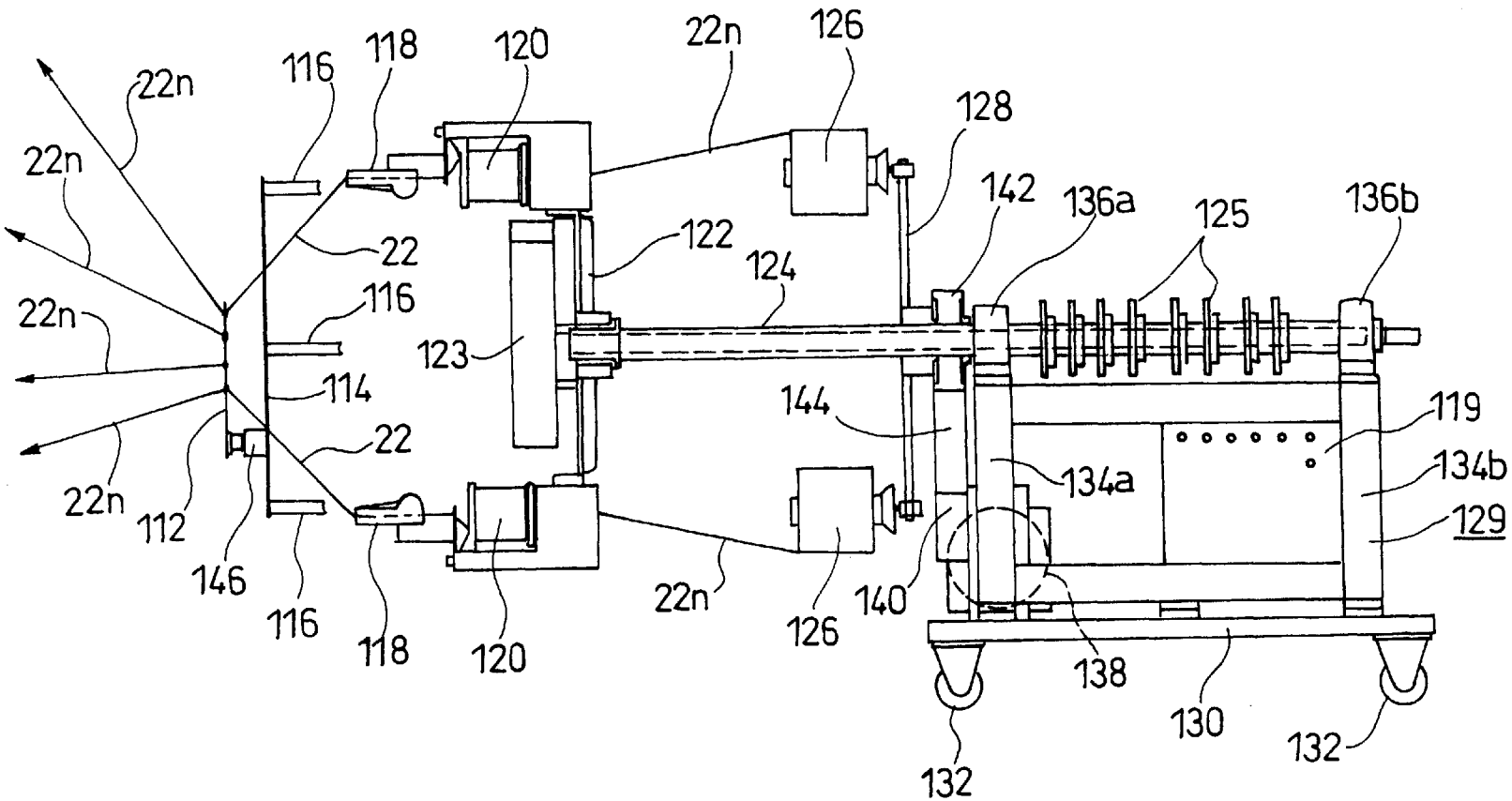
FIG. 15 is a view similar to FIG. 13 illustrating the rotary creel in operative state.
Figure 16:
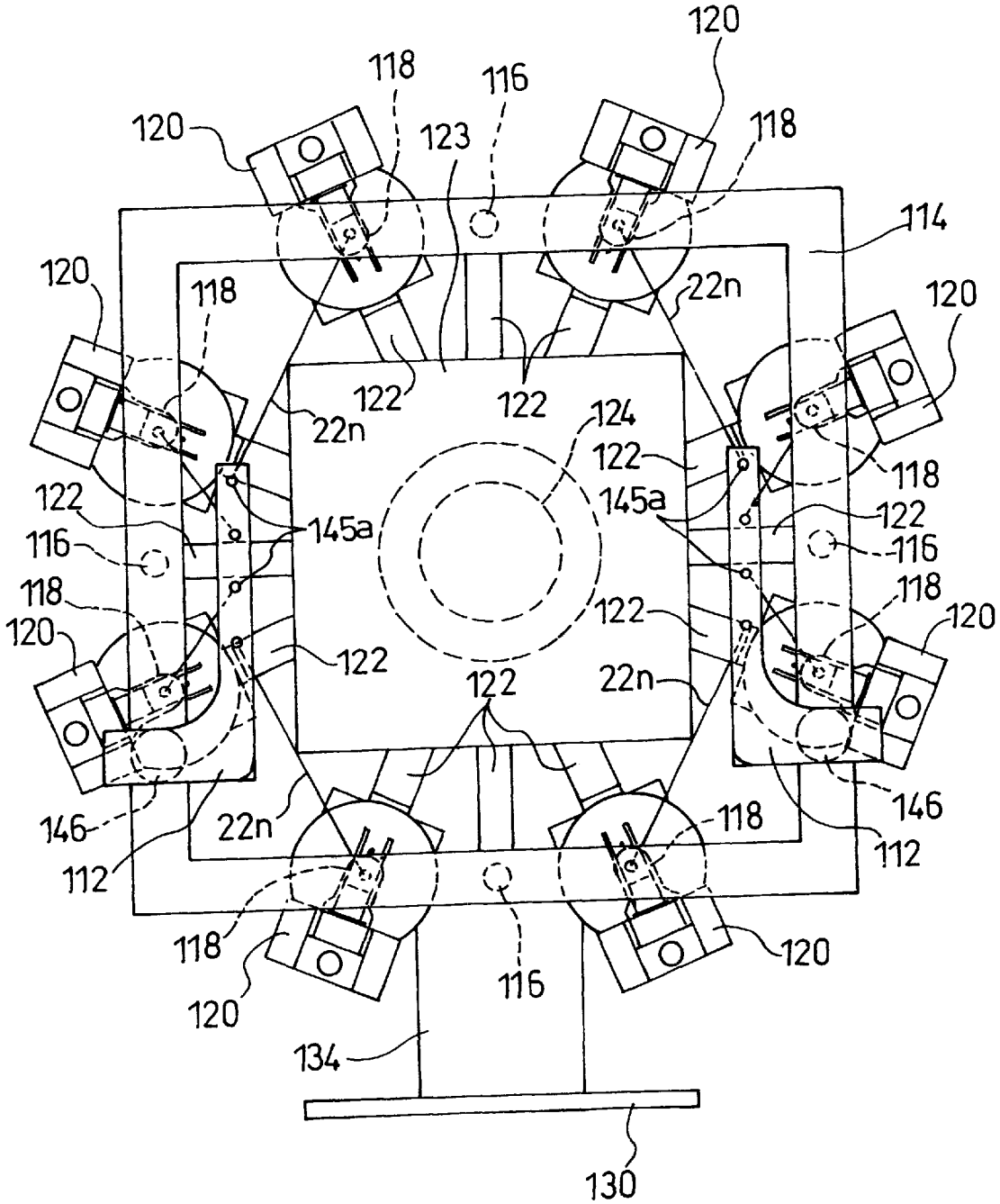
FIG. 16 is a front view of the rotary creel illustrated in FIG. 15.

The guide plate 112 is designed such that the pair of rotatable plates are raised and lowered as well as opened and closed by the guide plate driving unit 146 to take an inoperative state (lowered and closed) illustrated in FIGS. 13, 14 and an operative state (raised and open) illustrated in FIGS. 15, 16. During operation, the rotatable plates are raised and opened to effectively prevent a plurality of yarns supplied from the rotating bobbins 126 from becoming entangled.

Figure 17:
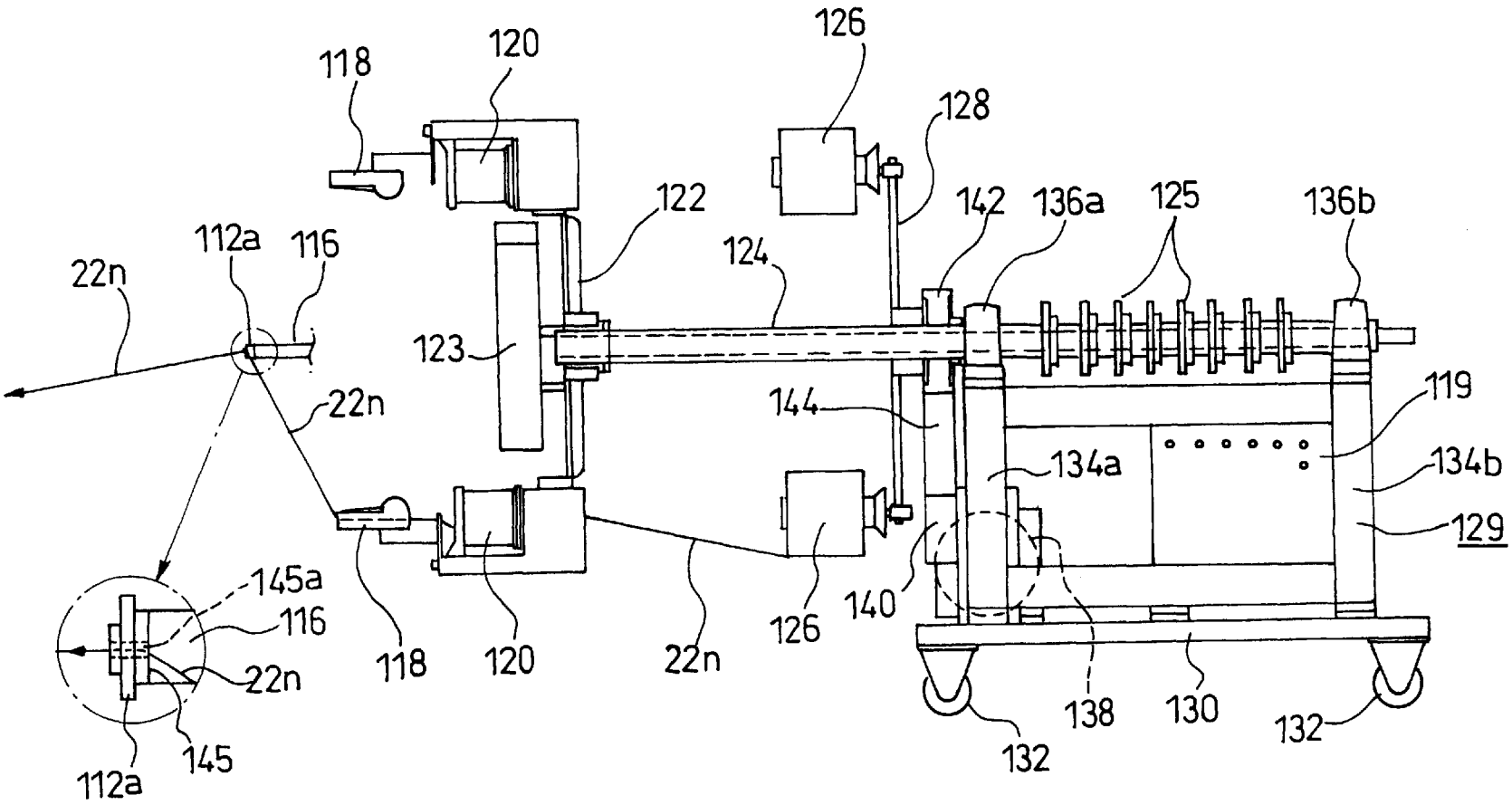
FIG. 17 is a lateral view illustrating another example of the rotary creel.
Figure 18:
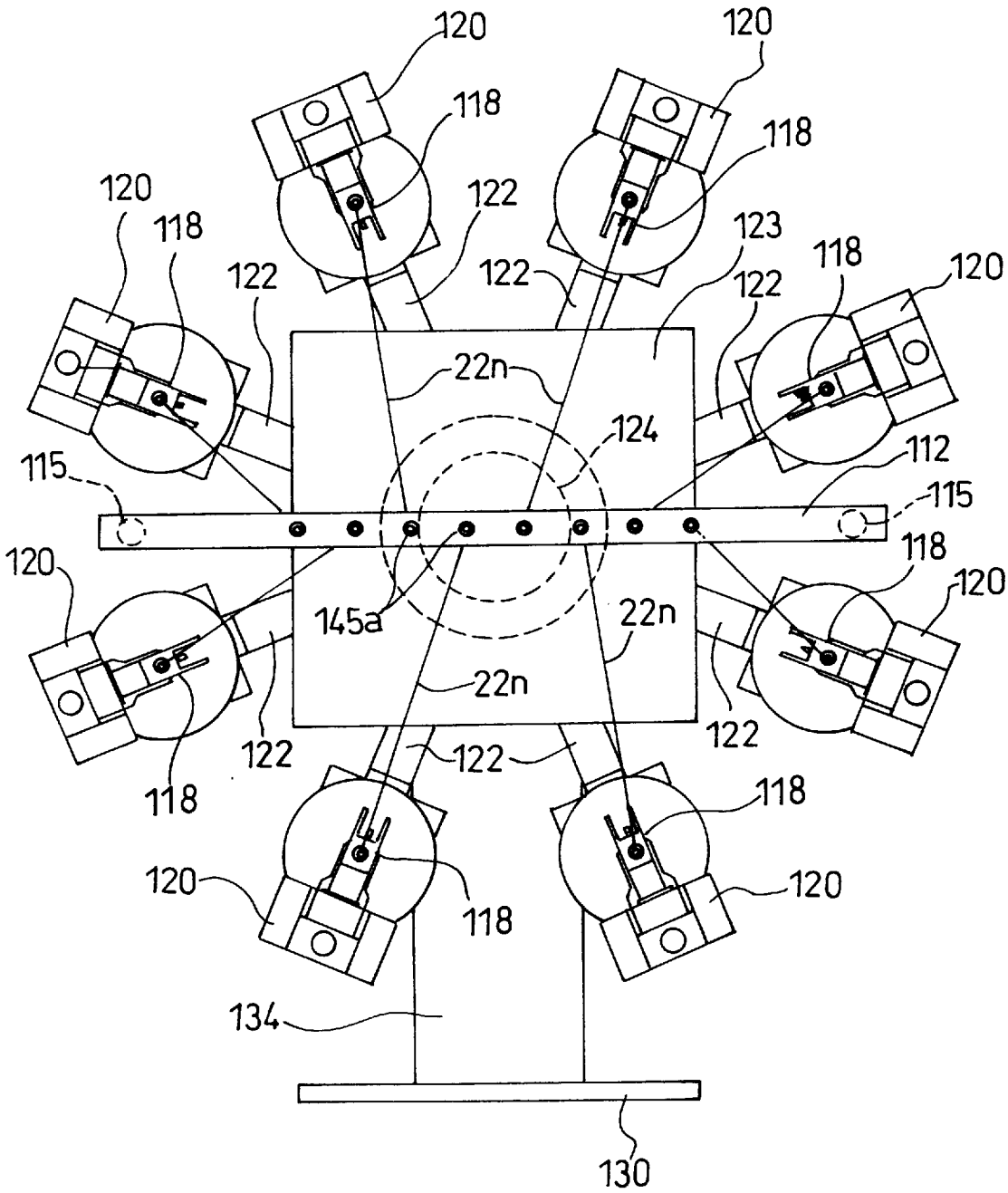
FIG. 18 is a front view of the rotary creel illustrated in FIG. 17.

Since the guide plate 112 is only required to prevent a plurality of yarns from becoming entangled, the guide plate 112 may be of course implemented by a single fixed plate member, as illustrated in FIGS. 17, 18, other than the guide plate 112 formed of a pair of rotatable plates, as the example illustrated in FIGS. 15, 16, which is constructed to raise and lower as well as open and close the rotatable plates. Alternatively, the guide plate 112 may be implemented by a structure comprising a single guide plate 112 arranged for vertical movement so that the guide plate 112 is lowered in an inoperative state and raised in an operative state.

A control box 119 controls an operational condition of the rotary creel F. While the control box 119 may be installed at any appropriate position, the illustrated example shows that the control box 119 is installed on the base plate 130. A relay box 123 is secured in a central portion of the front surface of the front holder. The control of the control box 119 for retaining yarns 22*n* in the yarn retainers 120 is relayed by the relay box 123.

Figure 12:
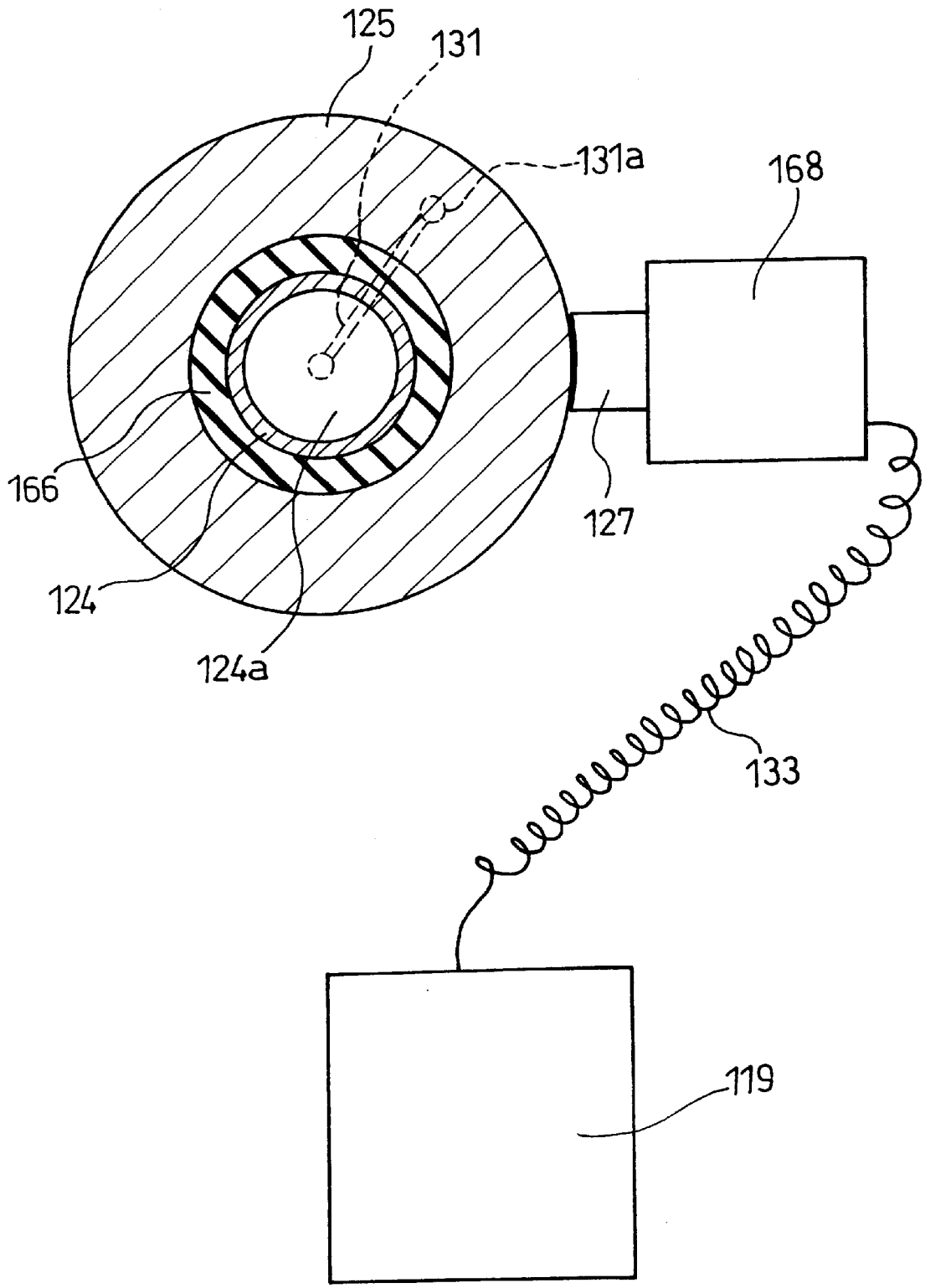
FIG. 12 is a partially cross-sectional view for showing a connection relationship between a spindle shaft and a control box.

Referring to FIG. 12, a plurality of slip rings 125 are mounted to a portion of the spindle shaft 124 positioned between the pillow bearings 136*a*, 136*b* through insulating materials 166 such as nylon. A carbon brush 127 is arranged to contact outer peripheral surfaces of the slip rings 125.

A carbon brush holder 168 for holding the carbon brush 127 is connected to the control box 119 through a wire 133.

A wire cord 131 is inserted into a hollow portion 124*a* of the spindle shaft 124, with one end 131*a* thereof being fixed to a slip ring 125 and the other end being connected to the foregoing relay box 123. In other words, the relay box 123 is electrically connected to the control box 119 so that the yarn retention control can be relayed by the control box 119.

Accordingly, the plurality of yarns 22*n* wound around the plurality of bobbins 126, respectively, pass through the yarn retainer 120, the yarn return member 118 and the guide plate 112. During a warping operation, the plurality of bobbins 126 are rotated together with the rotation of the spindle shaft 124, while maintaining a synchronous state with the rotation of the yarn introduction means 6, so that the yarns 22*n* are guided by the yarn introduction means 6 to be wound around the warper drum A. During a warping disabled state, the yarns 22*n* wound around the bobbins 126 pass the yarn retainer 120, the yarn return member 118 and the guide plate 112, and then guided by the yarn selection guide unit 27 and accommodated therein.

Figure 19:
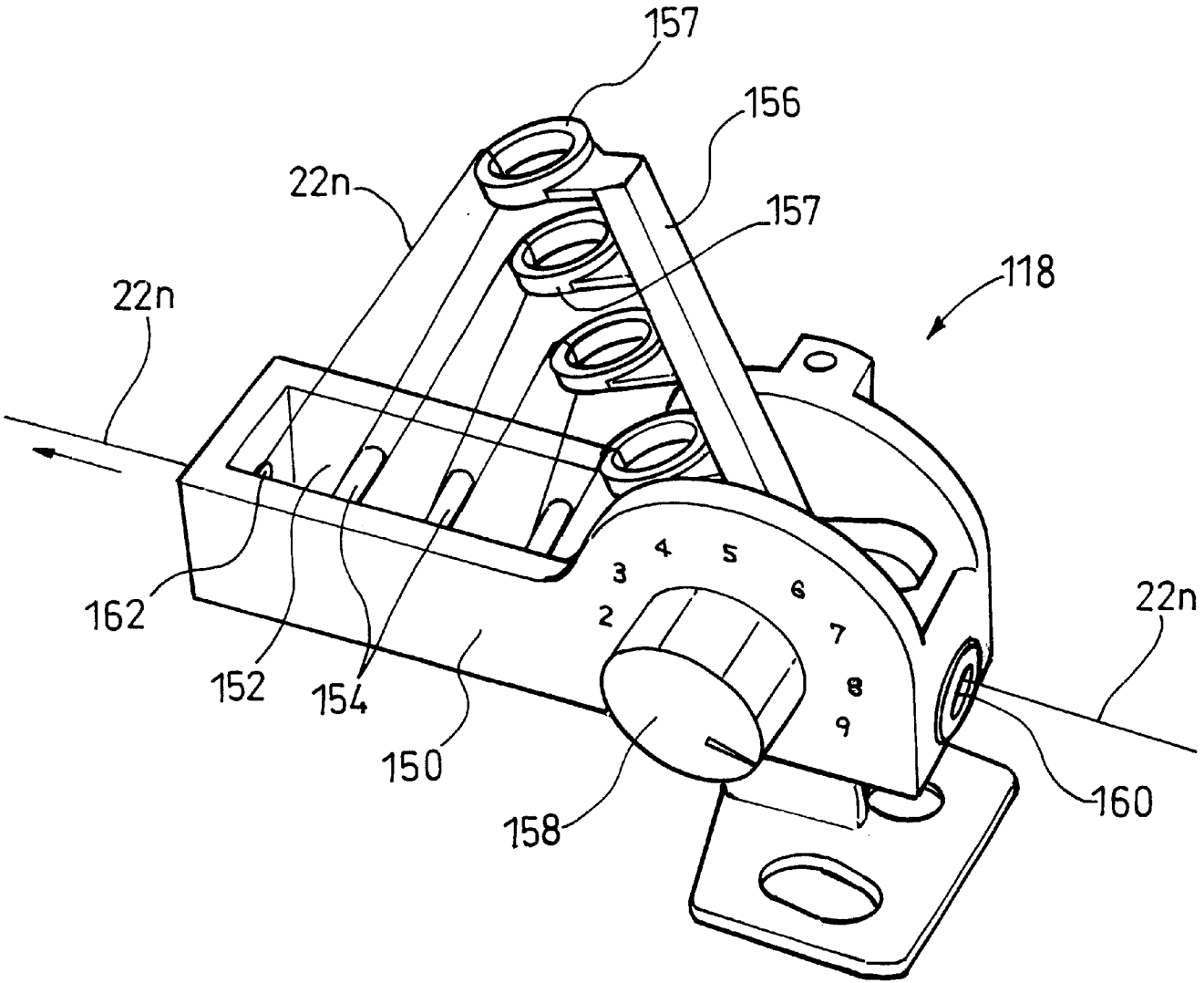
FIG. 19 is an enlarged perspective view of a yarn return unit.

The yarn return member 118 has an action of drawing back the yarn 22*n*, when it becomes loose, to eliminate a loose state of the yarn 22*n*. While any member may be used as the yarn return member 118 as long as it has a draw-back action, FIG. 19 illustrates a preferred implementation. In FIG. 19, the yarn return member 118 has a frame 150 with a hollow interior (hollow portion 152).

Within the front half of the frame 150, yarn pass bars 154 traverse the hollow portion 152. A swing arm 156 is usually urged upwardly about a base end to be rotatable in the vertical direction. The swing arm 156 has its base end mounted in the rear half of the frame 150, and a plurality of yarn pass rings 157 formed on the free end side. A dial 158 adjusts an upward urging force applied to the swing arm 156, and is rotatably mounted on the outer surface of the rear half of the frame 150.

The yarn 22*n* is inserted into yarn inlet hole 160 formed through a rear end wall of the frame 150. As illustrated, the yarn 22*n* is sequentially passed through the yarn pass rings 157 and around the yarn pass bars 154, and then drawn out to the outside from a yarn outlet hole 162 formed through a front end wall of the frame 150. By thus passing the yarn 22*n* through the yarn return member 118, when the yarn 22*n* become loose, the swing arm 156 swings upwardly to draw back the yarn 22*n* to eliminate the yarn looseness. On the other hand, when the yarn 22*n* is tensioned, the swing arm 156 swings downwardly. Therefore, the yarn return member 118, if provided, allows a tension balance of the yarn 22*n* to be constantly adjusted by upward and downward swing of the swing arm 156.

The yarn return unit 118 is capable of applying tensile force to the yarn 22*n* in warping, putting back toward the rotary creel F the yarn 22*n* loosened when yarn exchanging and applying force to the yarn 22*n* accommodated in the yarn selection guide 27 so as to always keep the yarn 22*n* in a state of tension.

Figure 33:
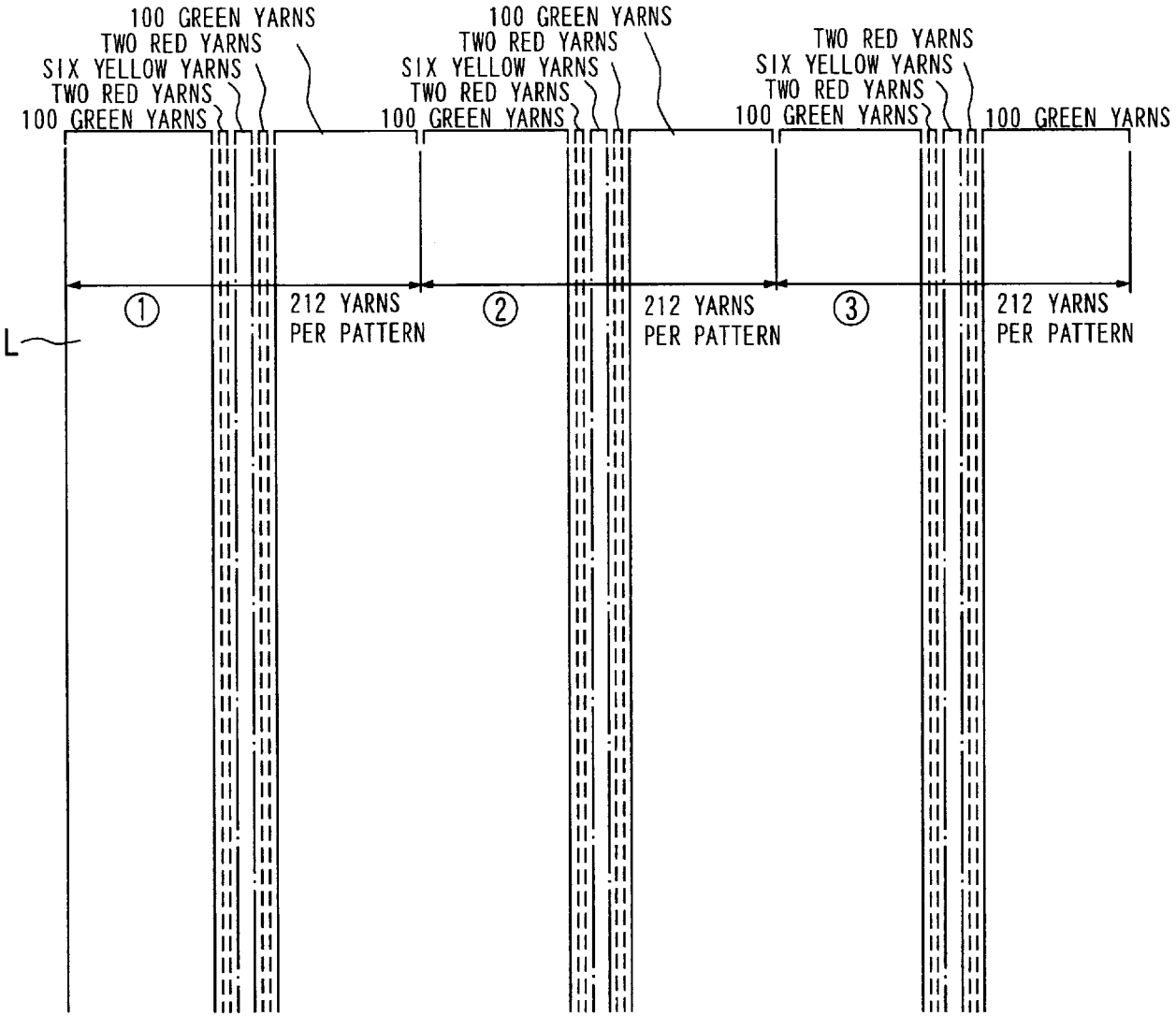
FIG. 33 is an explanatory diagram showing how warping is performed for the fabric illustrated in FIG. 29.
Figure 34:
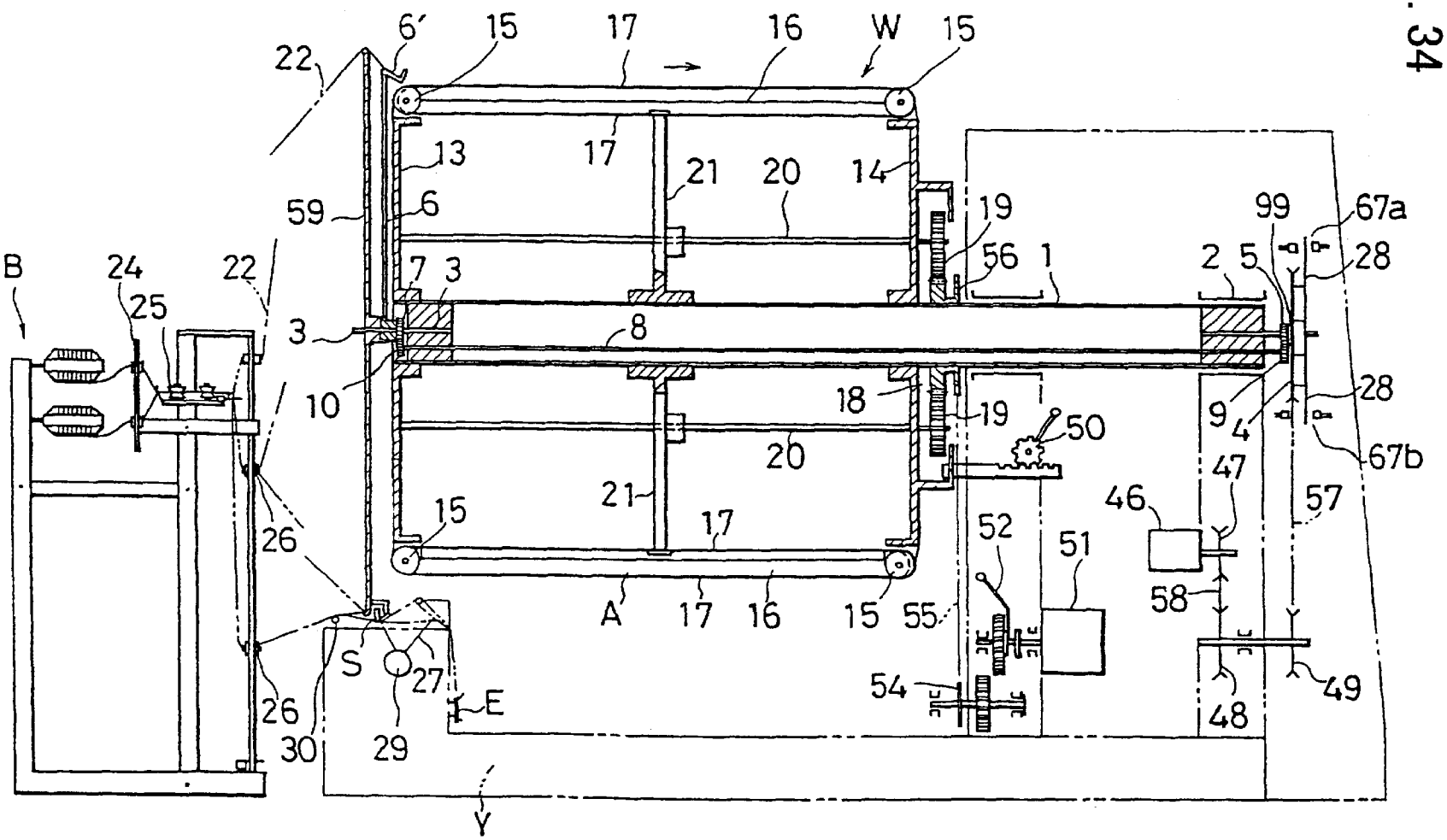
FIG. 34 is a schematic lateral cross-sectional view of a conventional electronically controlled sample warper.
Figure 35:
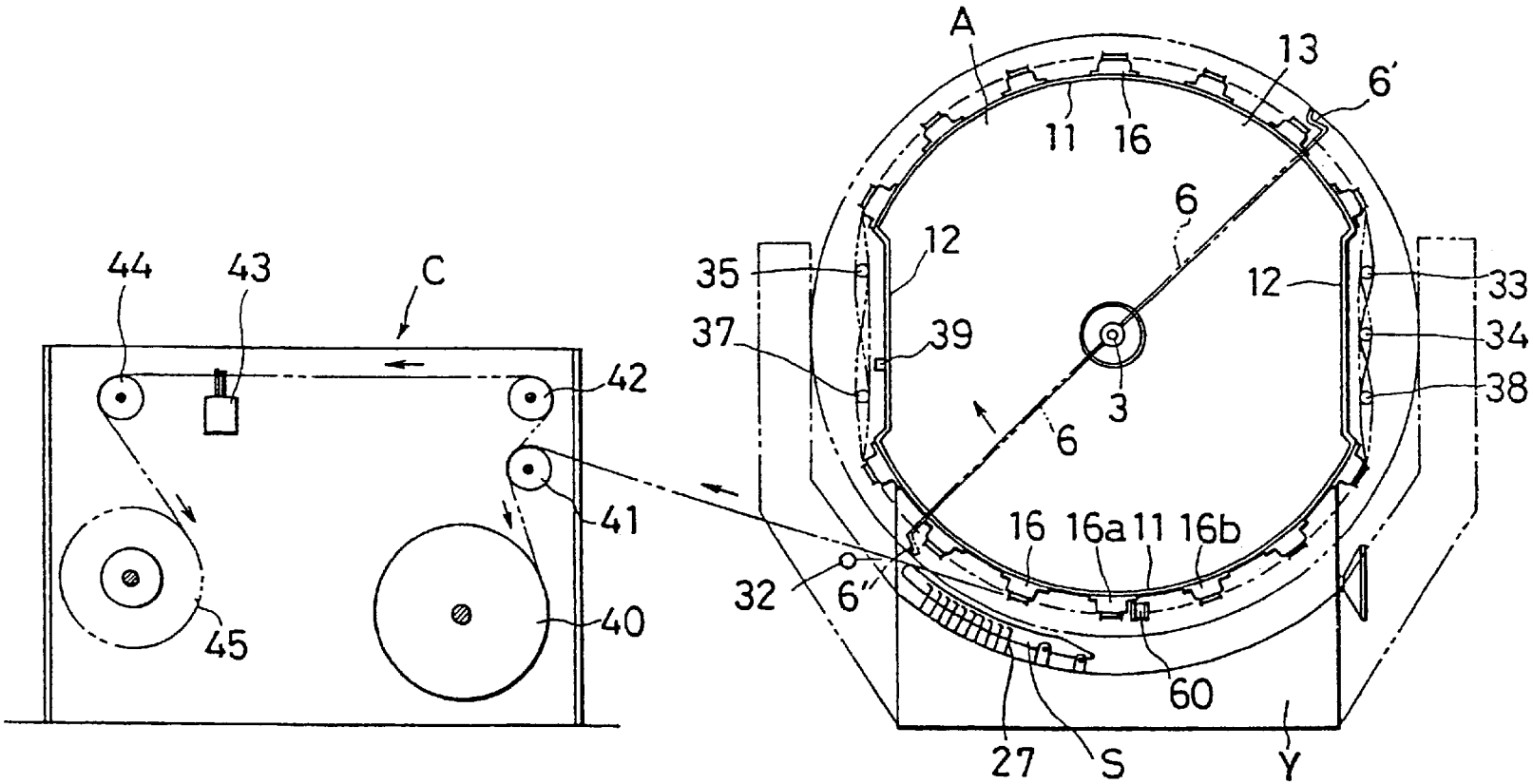
FIG. 35 is a schematic front view of the conventional electronically controlled sample warper illustrated in FIG. 34.
Figure 36:
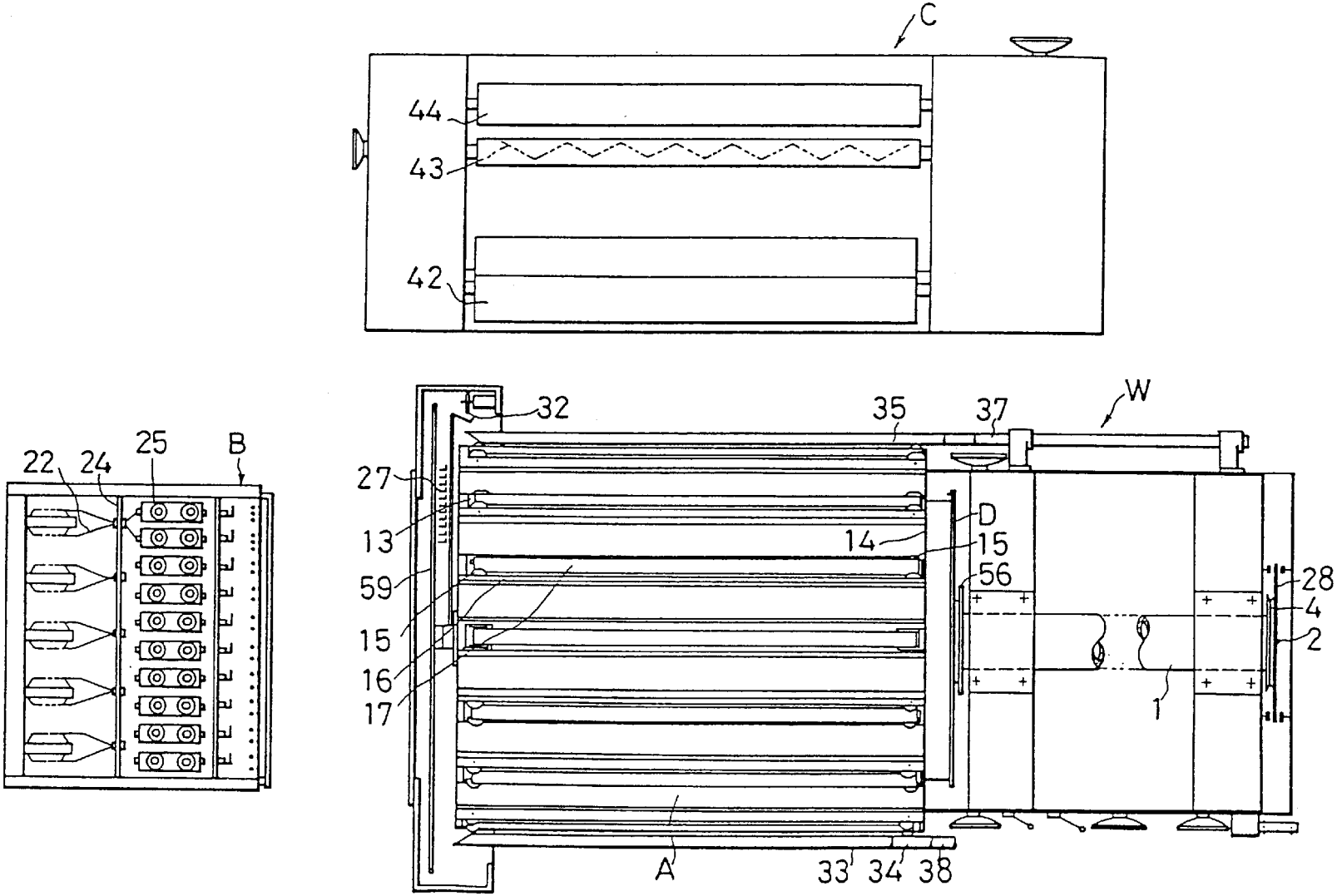
FIG. 36 is a schematic top plan view of the conventional electronically controlled sample warper illustrated in FIG. 34.
Figure 37:
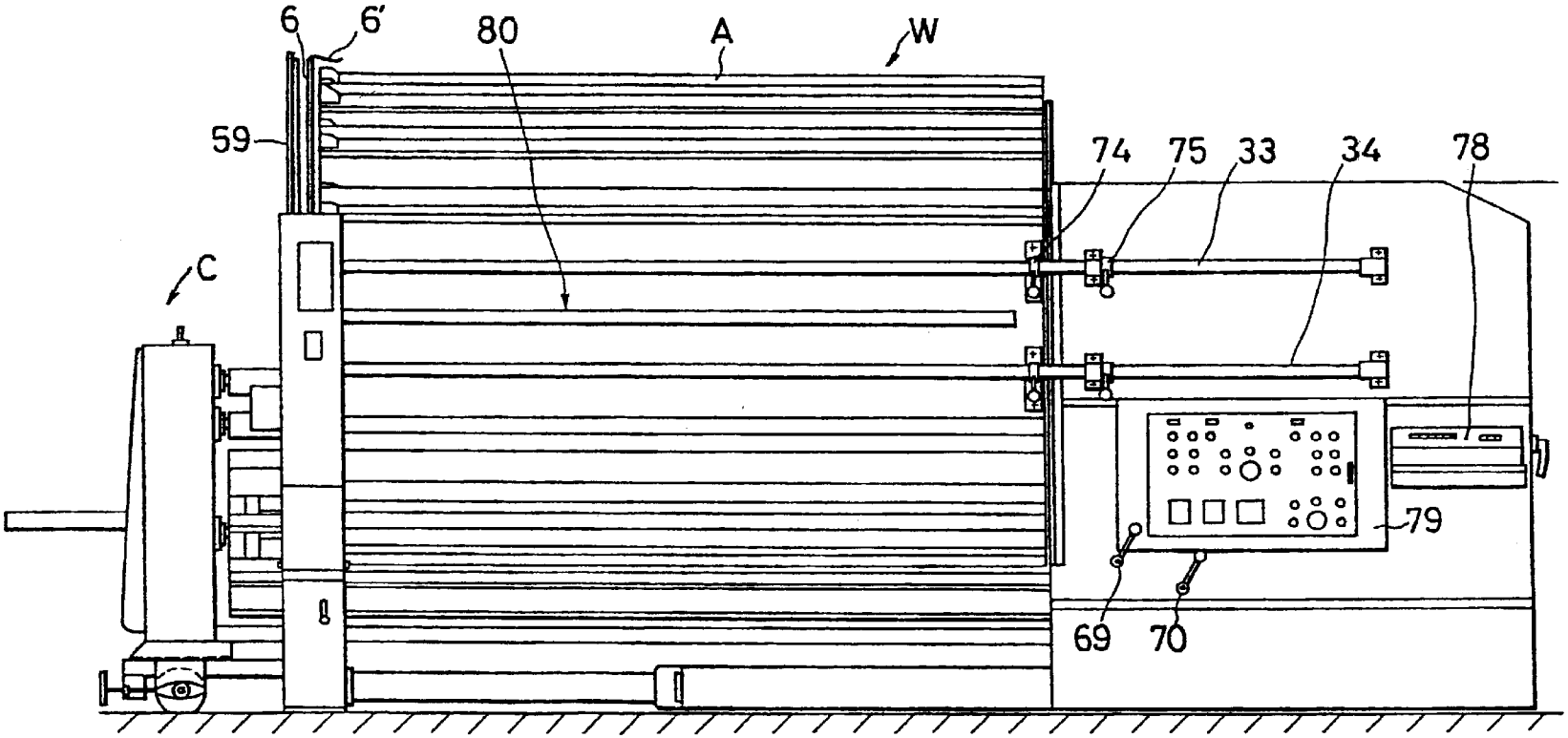
FIG. 37 is a schematic lateral view of the conventional electronically controlled sample warper illustrated in FIG. 34.
Figure 38:
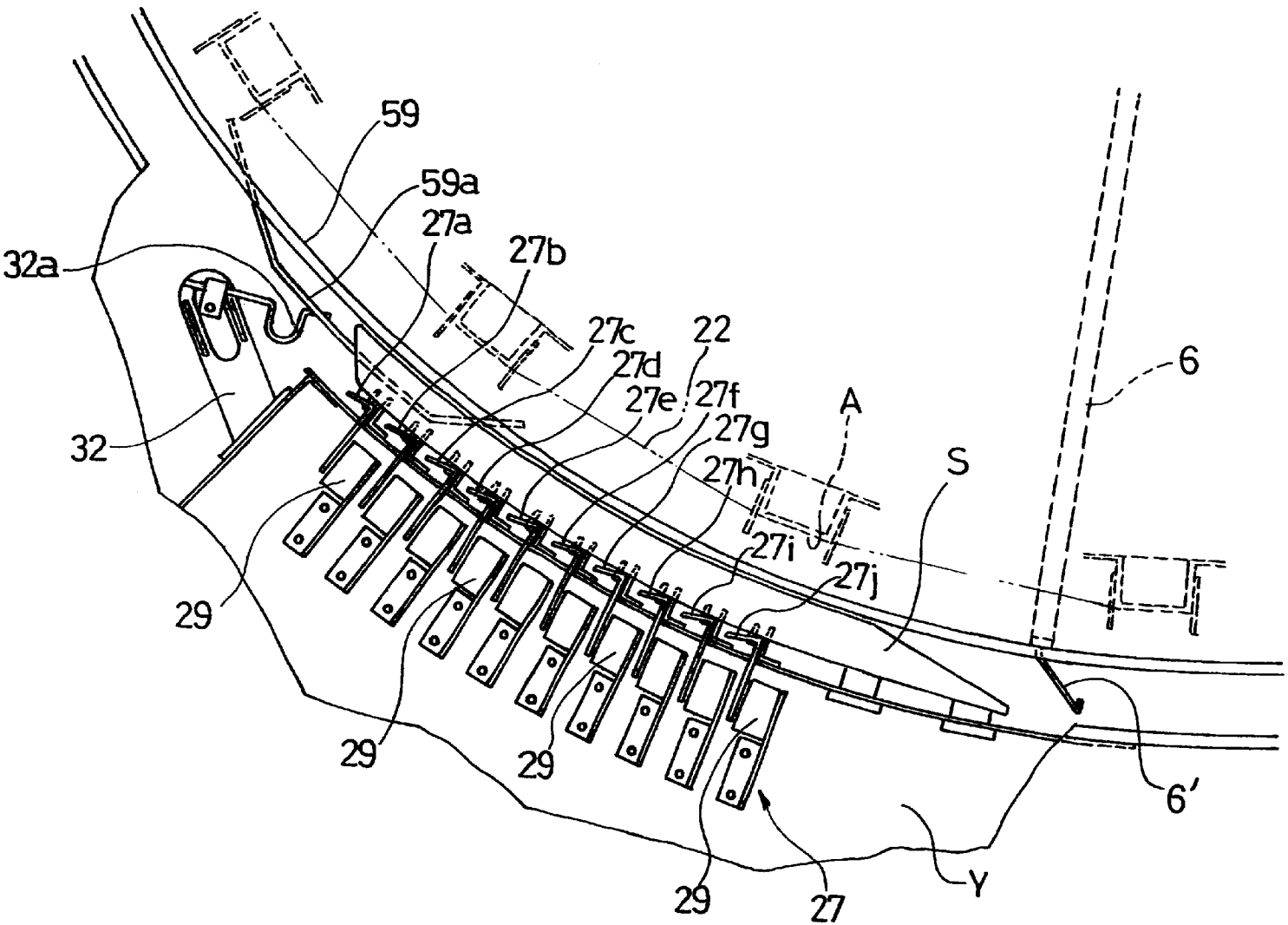
FIG. 38 is a schematic diagram illustrating a conventional yarn exchange mechanism.
Figure 39:
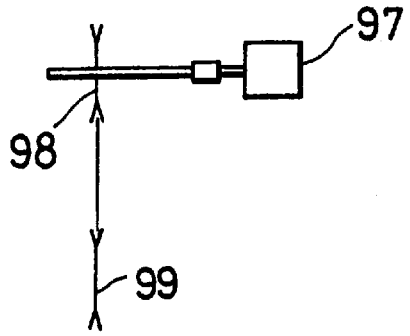
FIG. 39 is a diagram schematically showing how an encoder is mounted in the conventional electronically controlled sample warper.
Figure 40:
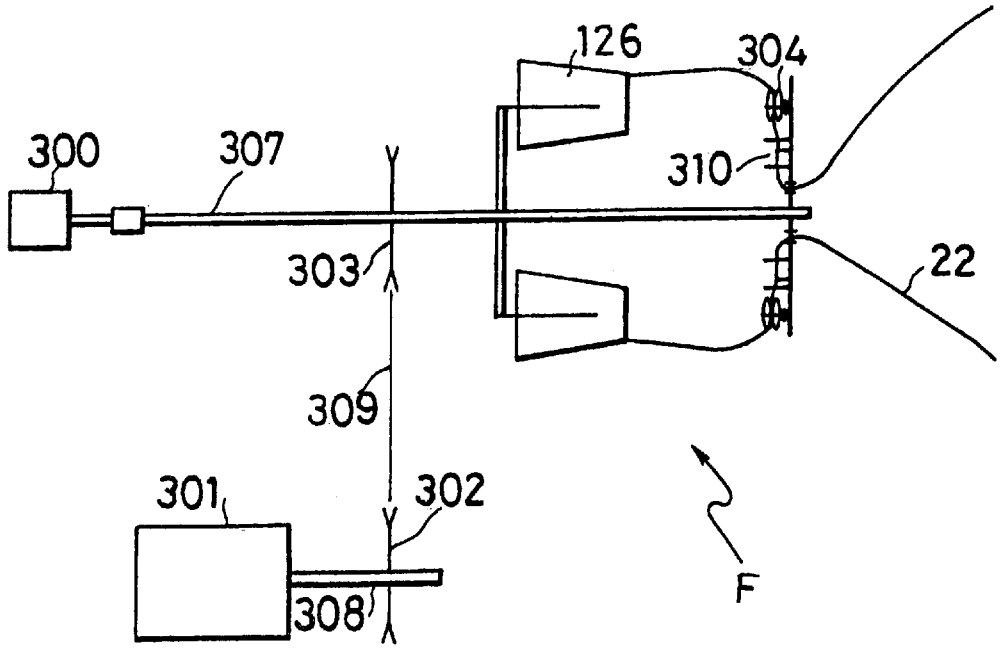
FIG. 40 is a schematic lateral cross-sectional view of a conventional rotary creel.
Figure 41:
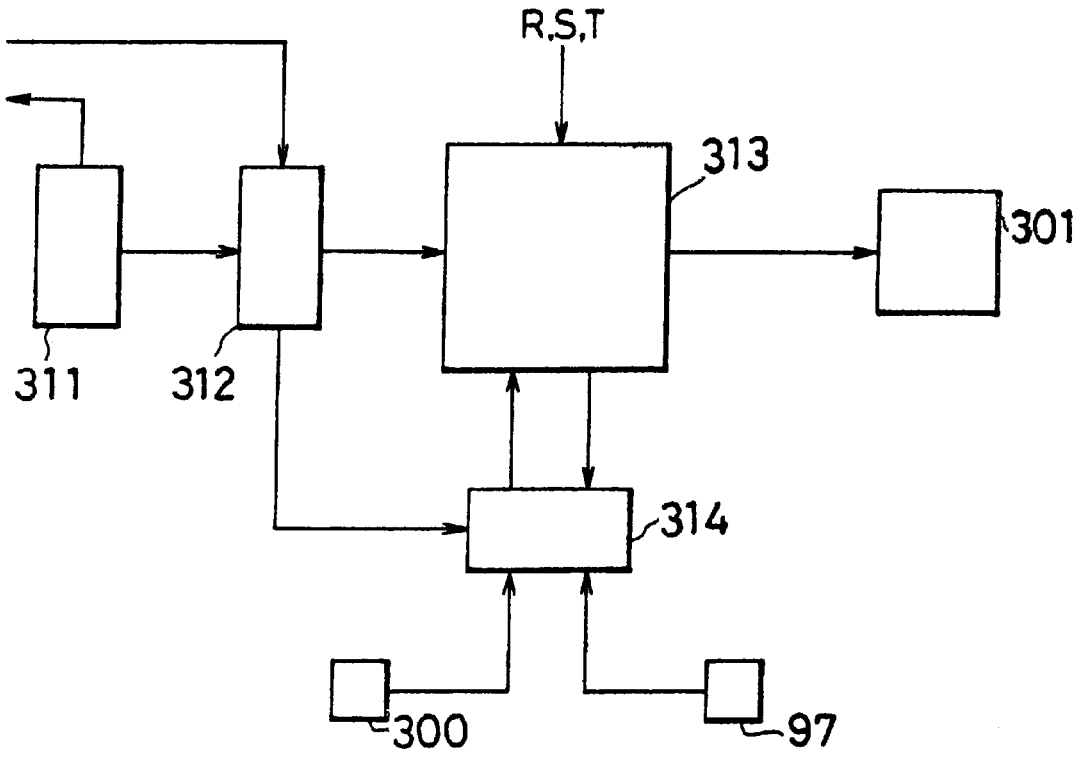
FIG. 41 is a block diagram illustrating the operation principles of the conventional rotary creel.

The example of the rotary creel illustrated in FIGS. 11–16 shows the yarn introduction member 6' arranged at the distal end of the yarn introduction means 6 illustrated in FIG. 1 which is formed by bending the distal end of the yarn introduction means 6 inwardly in a manner similar to the yarn introduction member 6 of the prior art warper illustrated in FIG. 33. In this case, an employed yarn removing mechanism includes a yarn removing unit 32 arranged corresponding to the yarn introduction member 6', as illustrated in FIG. 1, with a yarn removing part 32*a* adapted to protrude to remove a yarn 22 caught by the yarn introduction member 6'.

The conventional yarn removing mechanism, which is formed of a combination of the yarn introduction member 6' and the yarn removing unit 32 as illustrated in FIG. 33, however, has a problem in that a yarn is susceptible to loosen during yarn exchange and a long time is required to recover the yarn looseness. The yarn could be removed while eliminating or reducing the occurrence of the yarn looseness by actuating the yarn introduction member 6' itself without installing the conventional yarn removing unit 32 as mentioned. Such an example is illustrated in FIGS. 7–10.

Figure 9:
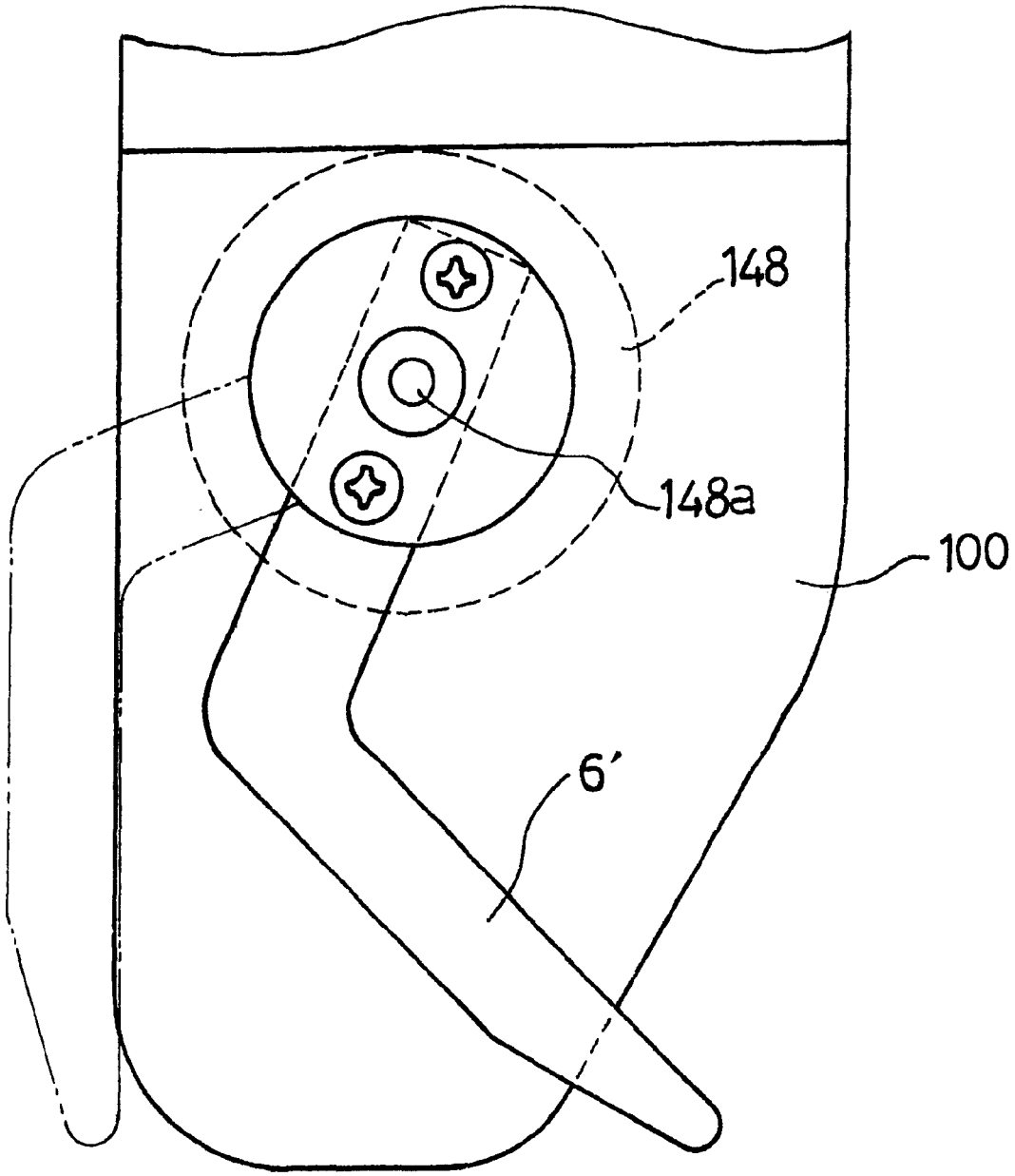
FIG. 9 is a plan view for explaining an example of a yarn introduction member.

FIG. 9 best illustrates the structure of the yarn introduction member 6'. In FIG. 9, a yarn introduction plate 100 is arranged at the distal end of the yarn introduction means 6. A rotary solenoid 148 is mounted to the yarn introduction plate 100, and the yarn introduction member 6' is mounted on the shaft 148*a* of the rotary solenoid 148 so as to be slidably movable on the top surface of the yarn introduction plate 100.

Figure 7:
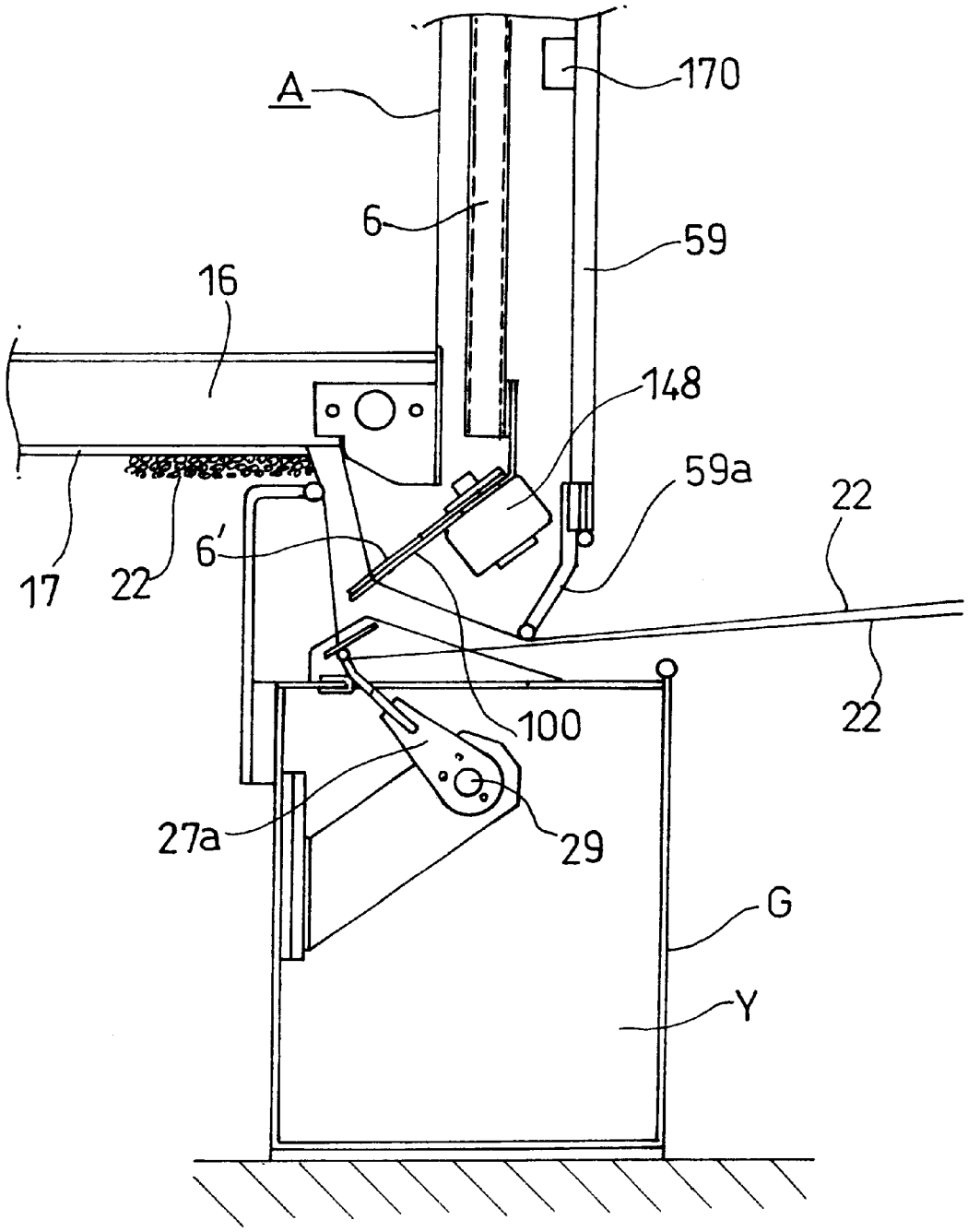
FIG. 7 is an enlarged lateral view illustrating the yarn selection guide unit of FIG. 5.
Figure 8:
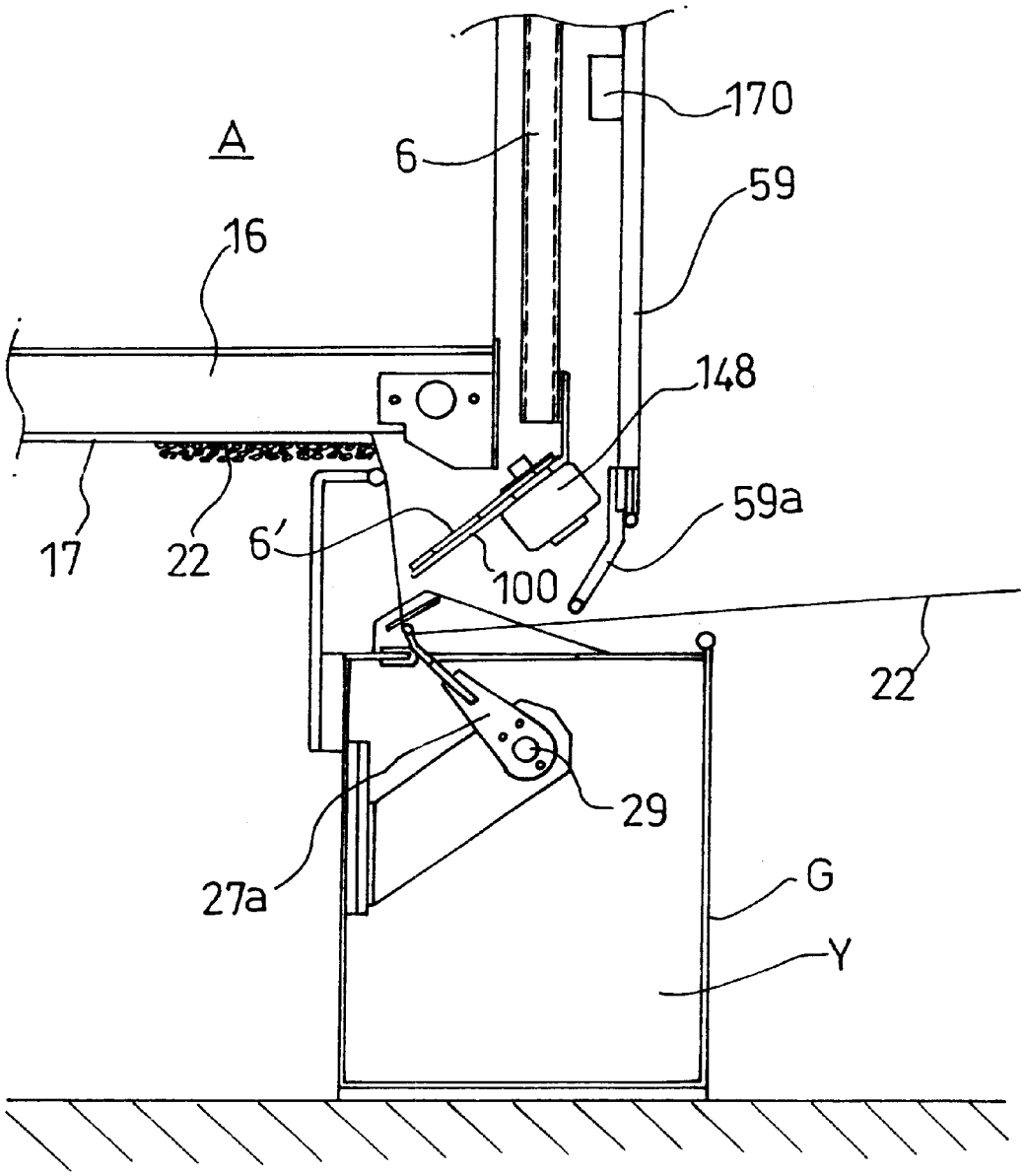
FIG. 8 is a view similar to FIG. 7 only illustrating a state in which yarns are accommodated in the yarn selection guide unit.
Figure 10:
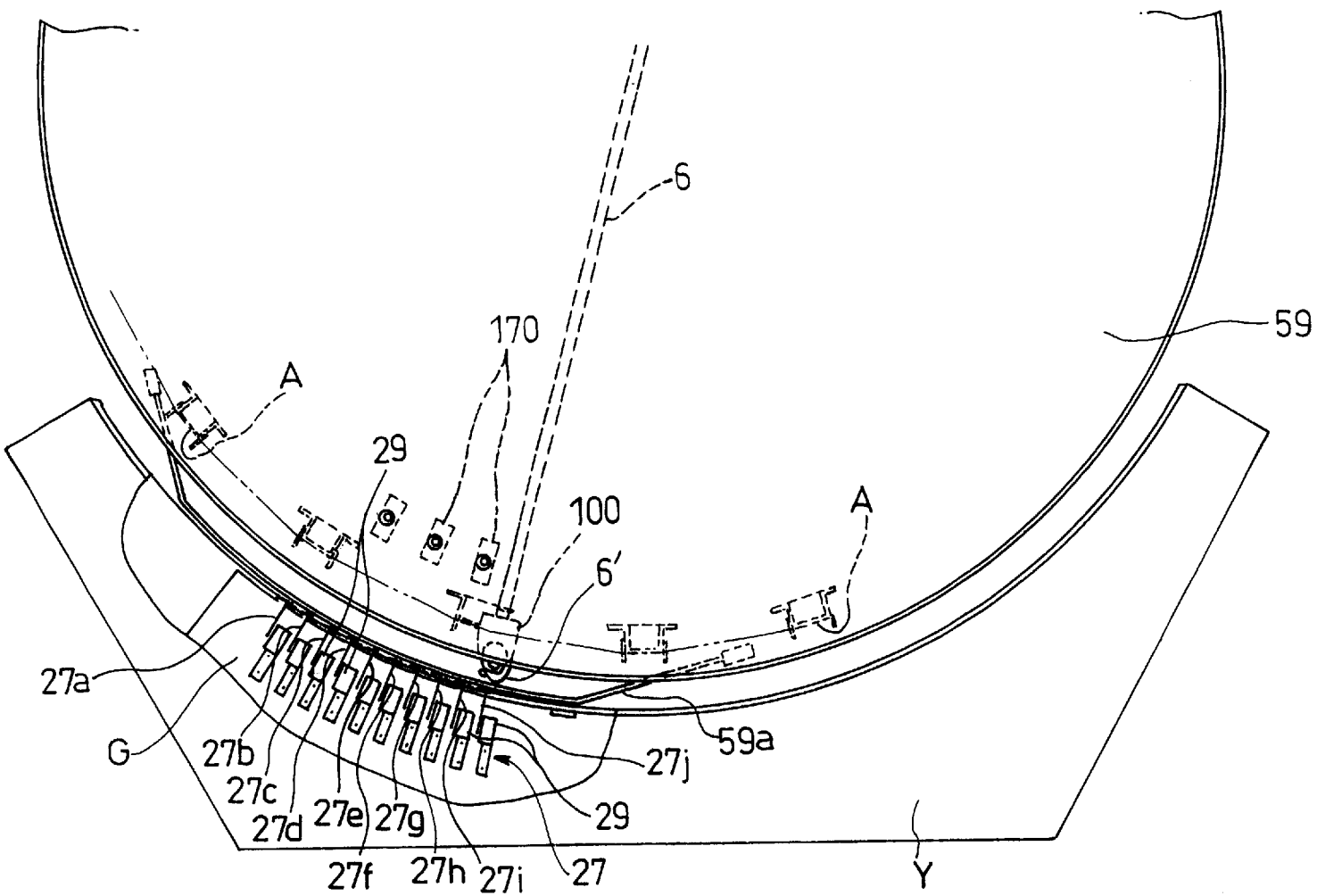
FIG. 10 is an enlarged view for showing the relationship between a yarn introduction means comprising the yarn introduction member of FIG. 9 and the yarn selection guide unit.
Figure 11:
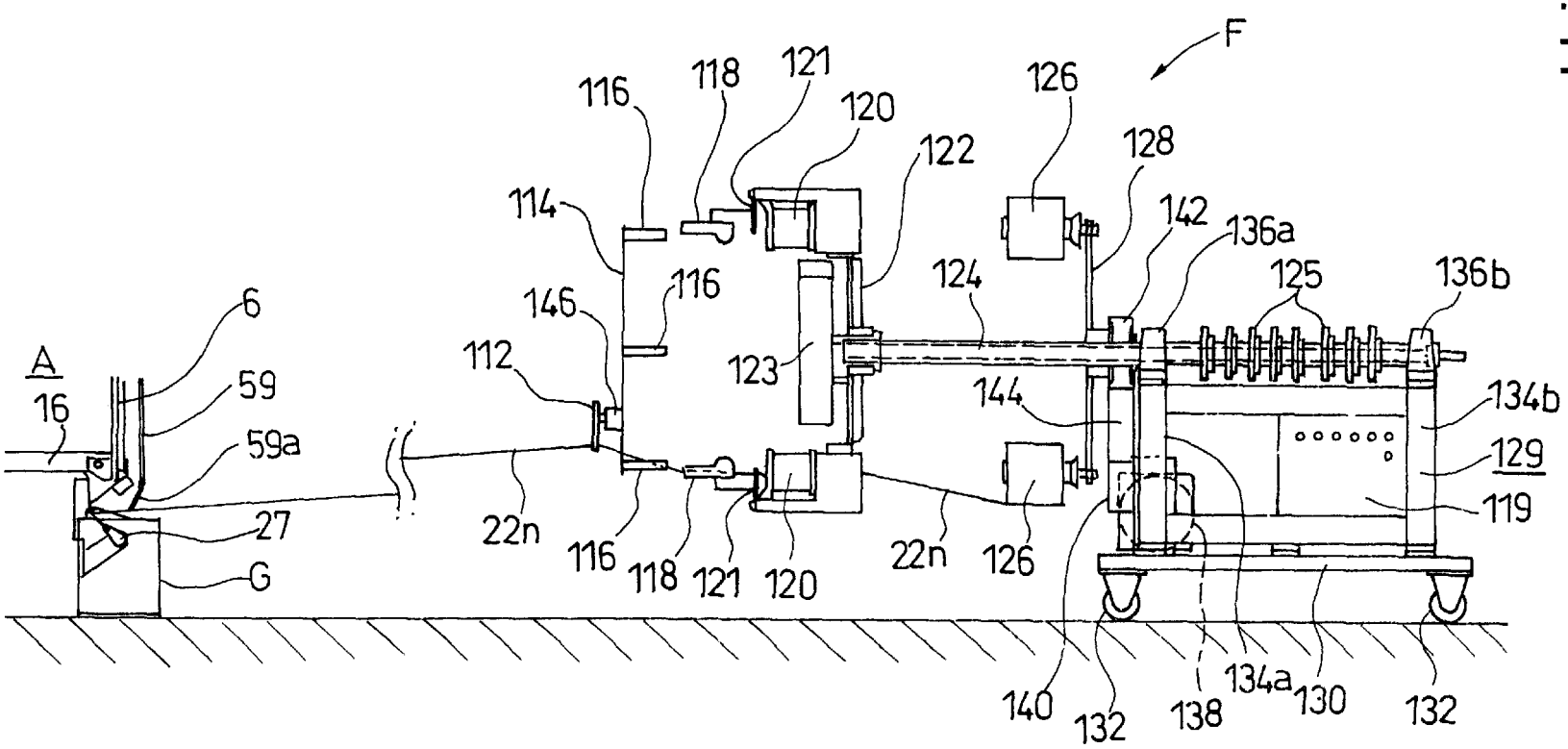
FIG. 11 is a lateral view for showing the positional relationship between the yarn selection guide unit and the rotary creel of the electronically controlled sample warper.

Referring next to FIGS. 7, 8 and 10, a plurality of sensor 170 are arranged at appropriate positions on a yarn introduction cover 59 or a guide bar 59*a* for sensing the position of the yarn introduction means 106. Each sensor 170 is positioned corresponding to an associated one of the yarn selection guides 27*a*–27*j*.

When a yarn 22 is to be exchanged, a yarn selection guide, for example, 27*a* accommodating the yarn 22 wound around a bobbin is moved toward a guide bar 36. After the yarn introduction means 6 passes the position of the yarn selection guide 27*a*, the sensor 170 corresponding to the yarn selection guide 27*a* senses the yarn introduction means 6 and generates a signal for actuating the rotary solenoid 148 which responsively begins actuating.

As the rotary solenoid 148 is actuating, the yarn introduction member 6' is rotated in the direction of removing the yarn 22 (a state indicated by phantom lines in FIG. 9) by the rotation of the rotary solenoid 148. As the yarn introduction member 6' is rotated in the yarn removing direction on a yarn contact surface of the yarn introduction plate 100, the yarn 22 held by the yarn introduction member 6' and the yarn introduction plate 100 slides on the yarn introduction plate 100 and is removed from the yarn introduction plate 100.

The removed yarn 22 is drawn back between the guide bar 59*a* and the base Y, and comes in contact with the yarn selection guide 27*a*. As the yarn selection guide 27*a*, which has been moved to the guide bar 59*a*, is accommodated in the base Y, the removed yarn 22 is also held by the yarn selection guide 27*a* and accommodated in the base Y (FIGS. 7 and 8).

The rotary solenoid 148 returns to its original state after the lapse of a predetermined time, and simultaneously with this, the yarn introduction member 6' is pivotally moved to protrude outwardly from the yarn introduction plate 100, as indicated by solid lines in FIG. 9. Then, a yarn selection guide for another yarn to be wound, for example, 27*e* is pivotally moved from the base Y to the guide bar 59*a*. Simultaneously, the yarn accommodated in the yarn selection guide 27*e* is released from the yarn selection guide 27*e*, and held between the yarn introduction plate 100 and the yarn introduction member 6', when the yarn introduction member 6' next passes the position of the yarn selection guide 27*e*, and wound on the warper drum A.

The employment of the yarn exchange mechanism as described above has an advantage of preventing or largely reducing the occurrence of large yarn looseness which has been inevitable during yarn exchange in conventional warpers. Other yarn exchange mechanisms may also be employed for realizing the prevention or reduction of yarn looseness, other than the structure illustrated in FIGS. 7–10. In the following, an alternative yarn exchange mechanism will be described.

Figure 20:
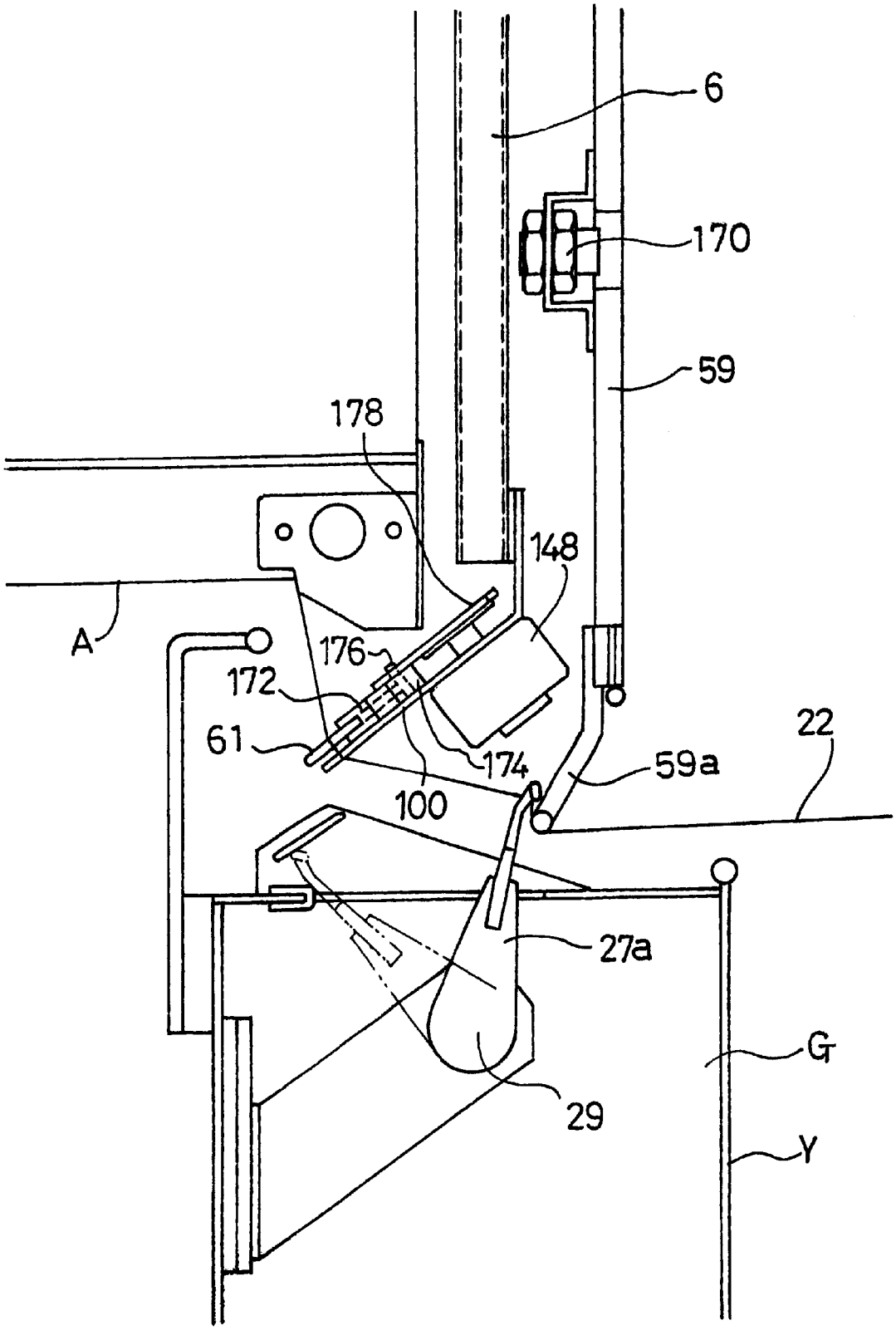
FIG. 20 is an enlarged lateral view of a yarn selection guide unit showing a state in which a yarn exchange operation is performed by another yarn exchange mechanism.
Figure 21:
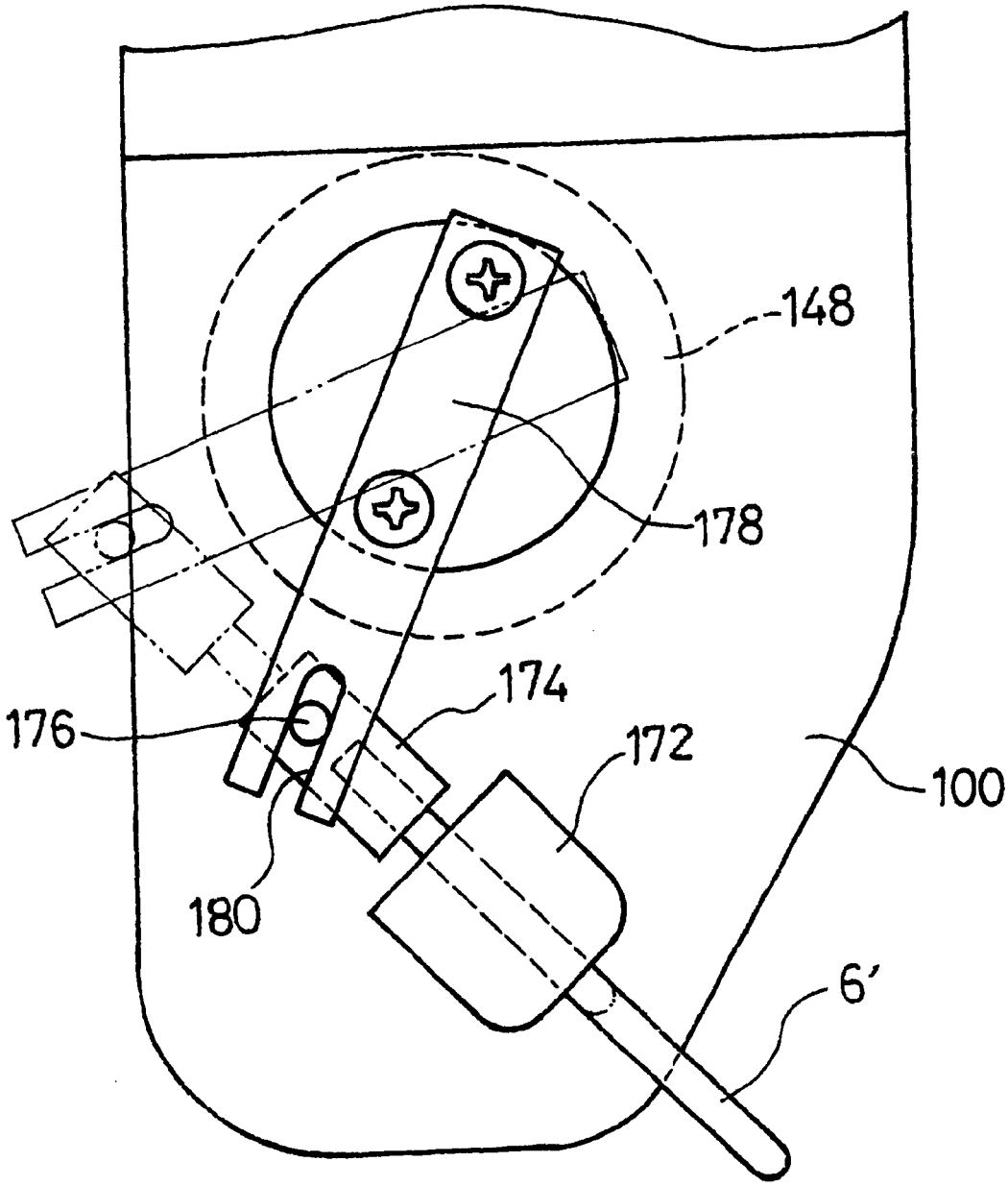
FIG. 21 is a partial plan view for showing a mechanism for actuating the yarn introduction member used in the yarn selection guide unit of FIG. 20.

FIGS. 20 and 21 illustrates an alternative yarn exchange mechanism. FIG. 21 best illustrates the structure of the yarn introduction member 6', wherein a yarn introduction plate 100 is mounted to the yarn introduction means 6. A supporting member 172 is mounted to the yarn introduction plate 100. The yarn introduction member 6' is mounted to the supporting member 172 so as to be slidable in forward and backward directions.

The base end of the yarn introduction member 6' is fixed to a block 174. A pin 176 is mounted to the block 174. A rotary solenoid 148 is mounted on the yarn introduction plate 100, and an arm 178 is attached to the rotary solenoid 148. The arm 178 is formed with an engagement groove 180 in a distal end portion, in which the pin 176 is engaged.

When a yarn 22 is to be exchanged, a yarn selection guide accommodating the wound yarn 22, for example, 27*a* is moved toward the guide bar 59*a*. When the yarn introduction means 6 passes the position of the yarn selection guide 27*a*, the sensor 170 corresponding to the yarn selection guide 27*a* senses the yarn introduction means 6 and generates a signal for actuating the rotary solenoid 148 which responsively begins actuating.

As the rotary solenoid 148 is actuated, the yarn introduction member 6' is retracted toward the inside of the yarn introduction plate 100 by the rotation of the arm 178 (a state indicated by phantom lines in FIG. 21). When the yarn introduction member 6' is retracted into the inside of the yarn introduction plate 100, the yarn 22 held by the yarn introduction plate 100 and the yarn introduction member 6' slides on the yarn introduction plate 100, and is removed from the yarn introduction plate 100.

The removed yarn 22 is drawn back between the guide bar 59*a* and the base Y, and comes in contact with the yarn selection guide 27*a*. As the yarn selection guide 27*a*, which as been moved to the guide bar 59*a*, is accommodated in the base Y, the removed yarn 22 is held by the yarn selection guide 27*a* and accommodated together in the base Y. The rotary solenoid 148 returns to its original state after the lapse of a predetermined time, and simultaneously with this, the yarn introduction member 6' slides to protrude outwardly from the yarn introduction plate 100 as indicated by solid lines in FIG. 21.

When a yarn select guide for a yarn 22 to be next wound, for example, 27*e* is rotated from the base Y to the guide bar 59*a*, the yarn 22 accommodated therein is released from the yarn select guide 27*e*, held between the yarn introduction plate 100 and the yarn introduction member 6' as the yarn introduction plate 100 passes the position of the yarn select guide 27*e*, and wound on the warper drum.

Figure 22:
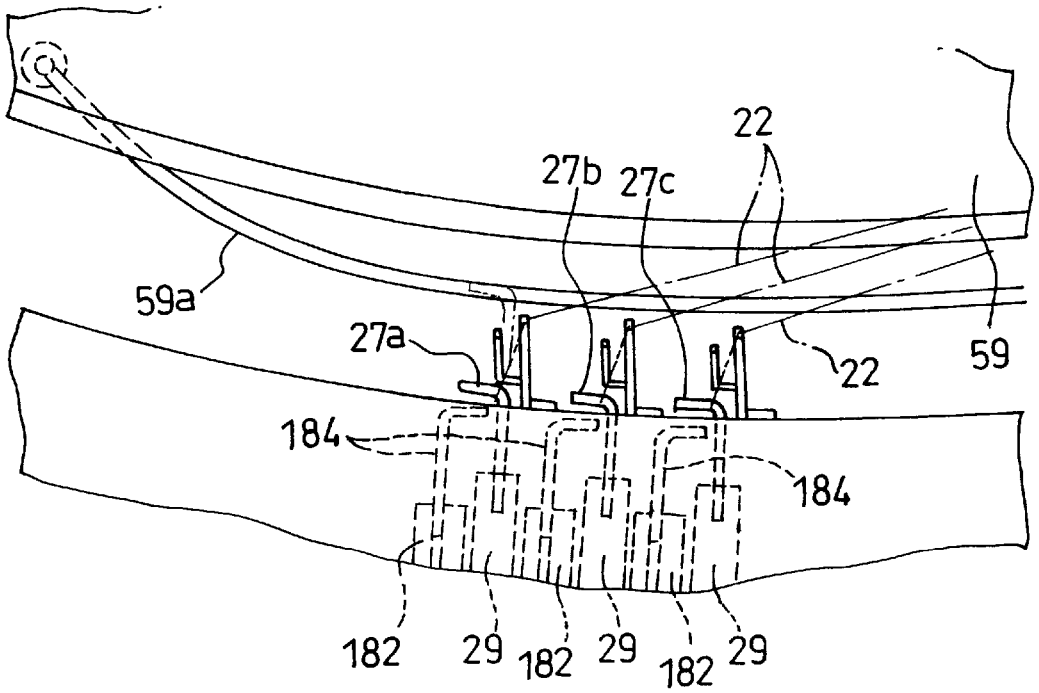
FIG. 22 is a schematic front view illustrating the structure of another yarn exchange mechanism.

Next, another alternative embodiment of the yarn exchange mechanism will be described with reference to FIGS. 22–28. As illustrated in these figures, a yarn removing member 184 which is linearly (or diagonally) moved, for example, by a solenoid controlled or air pressure controlled actuator 182 is arranged corresponding to each of yarn selection guides 27*a*–27*h* (of which 27*a*–27*c* only are illustrated in FIG. 22). The yarn removing members 184, which exhibit vertically linear movements, are arranged for advancement and retraction near the yarn selection guides 27*a*–27*j*. More preferably, the yarn removing members 184 are positioned downstream of the yarn selection guides 27*a*–27*j* relative to the rotating direction of the yarn introduction member 6'.

Figure 23:
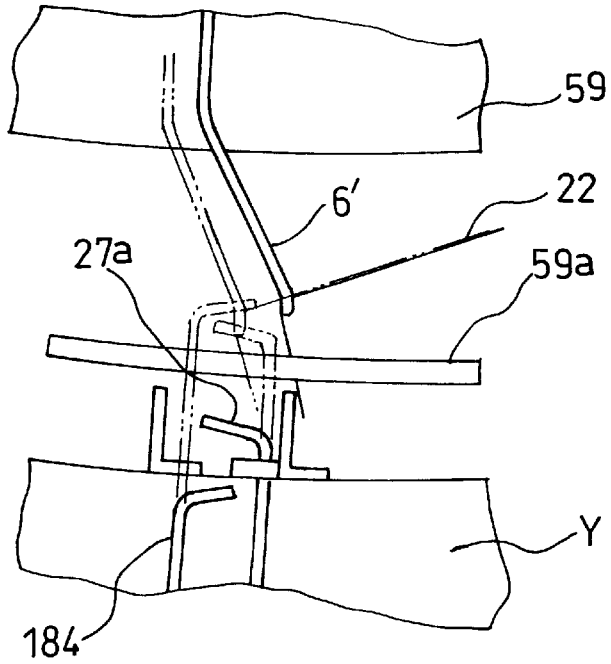
FIG. 23 is a partially enlarged view of FIG. 22.
Figure 24:
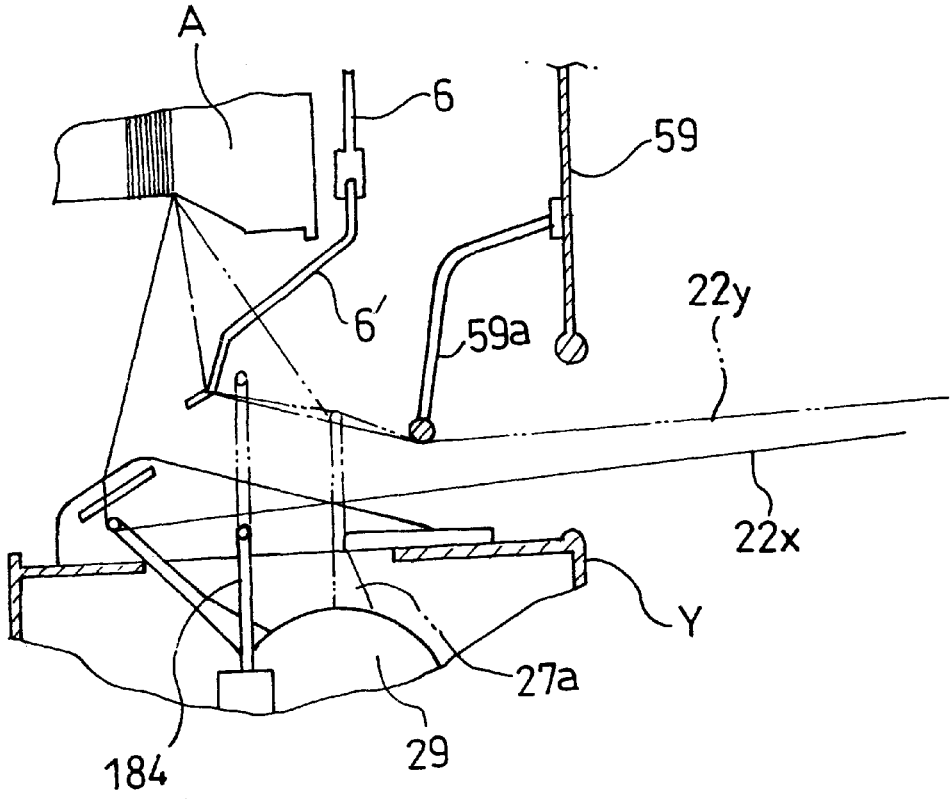
FIG. 24 is a partial cross-sectional view illustrating a step of a yarn exchange operation by the yarn exchange mechanism of FIG. 22.
Figure 25:
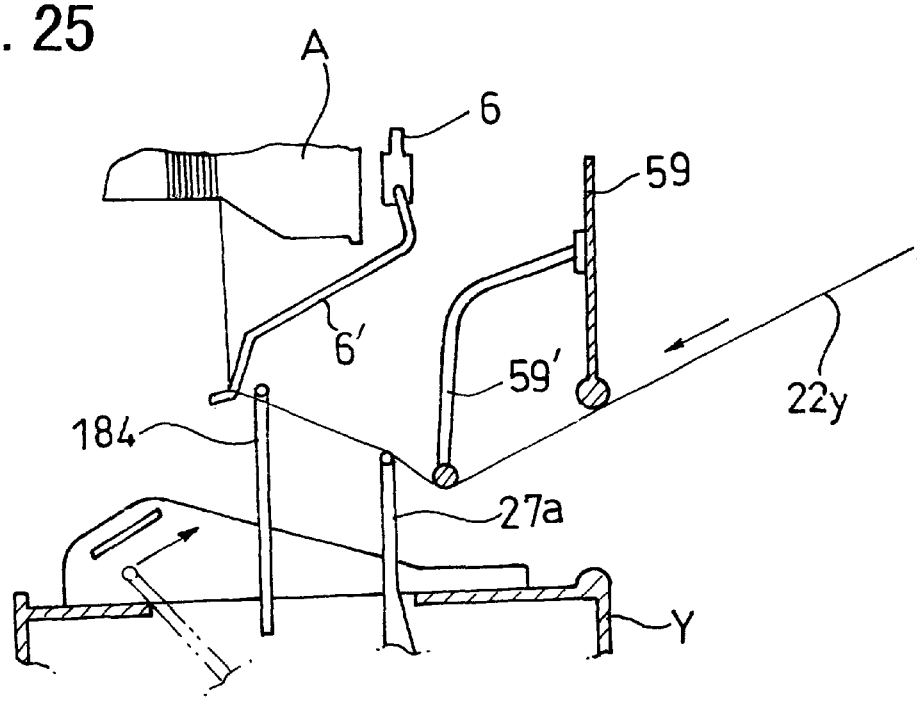
FIG. 25 is a partial cross-sectional view illustrating another step of a yarn exchange operation by the yarn exchange mechanism of FIG. 22.
Figure 26:
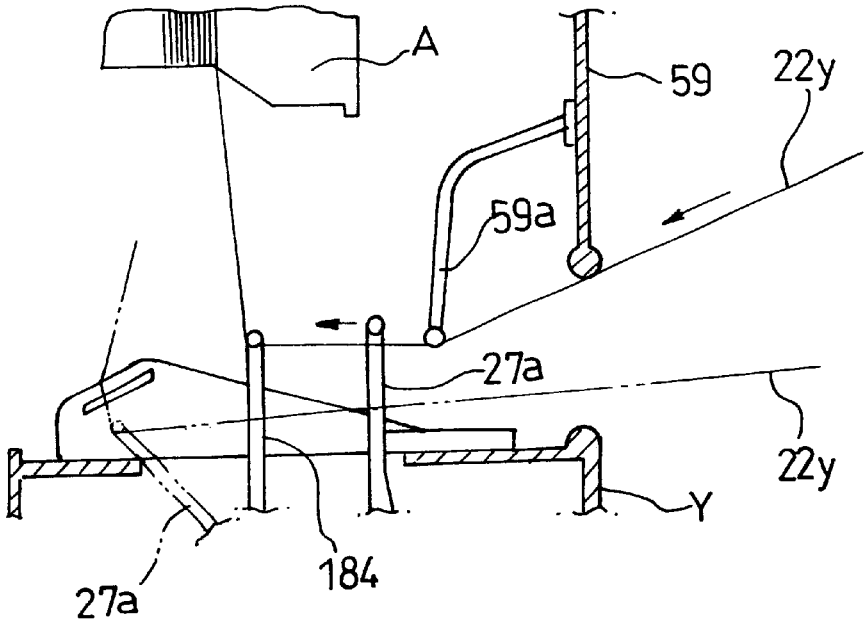
FIG. 26 is a partial cross-sectional view illustrating a yet another step of a yarn exchange operation by the yarn exchange mechanism of FIG. 22.
Figure 27:
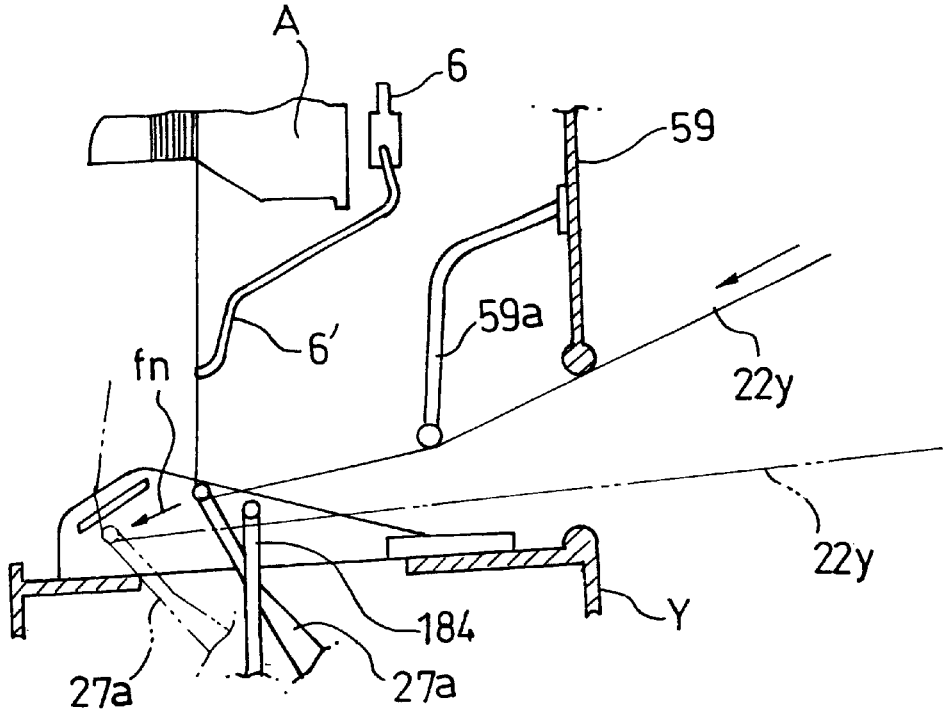
FIG. 27 is a partial cross-sectional view illustrating a further step of a yarn exchange operation by the yarn exchange mechanism of FIG. 22.
Figure 28:
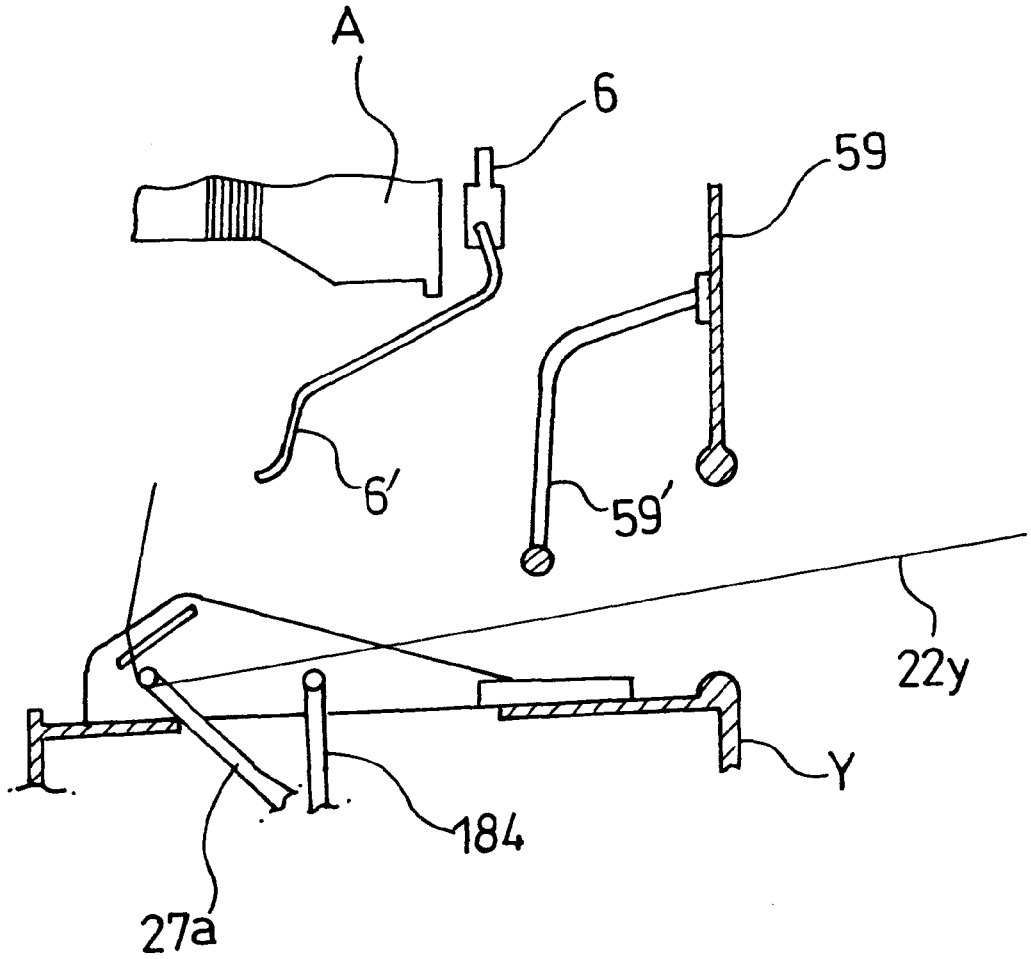
FIG. 28 is a partial cross-sectional view illustrating a yet further step of a yarn exchange operation by the yarn exchange mechanism of FIG. 22.

The yarn removing members 184 can take a position indicated by solid lines in FIGS. 23, 24 and 28, a raised yarn removing position shown in FIG. 25, or a third yarn passing position shown in FIGS. 26 and 27.

Referring specifically to FIG. 24, a yarn 22*y*, guided by the yarn introduction member 6' of the yarn introduction means 6, is wound on the warper drum A. Another yarn 22*x* is at a standby position, and the yarn removing member 184 is at a lower position.

As a predetermined winding of the yarn 22*y* is terminated, the yarn removing member 184 associated with the yarn 22*y* is raised to the yarn removing position shown in FIG. 25, while a corresponding yarn selection guide, for example, 27*a* is moved to a predetermined yarn exchange position.

At this yarn removing position, the yarn 22*y* is removed from the yarn introduction member 6' by the yarn introduction member 184. The yarn removing member 184, which has removed and holds the yarn 22*y*, is lowered to an intermediate position shown in FIG. 26, and simultaneously, the yarn 22*y* is also lowered, guided by the yarn removing member 184.

At this time, the yarn selection guide 27*a* is moved from the position shown in FIG. 26 to a position indicated by dotted lines in FIG. 27 in a direction indicated by an arrow fn in FIG. 27. As a result, the yarn 22*y*, held by the yarn selection guide 27*a*, is guided to a standby position in FIG. 28.

For the yarn introduction means 6 to catch a different yarn, another yarn selection guide, for example, 27*b* is pivotally moved to advance to the yarn exchange position, causing the rotating yarn introduction means 6 to hold the yarn which is then wound around the warper drum A.

While the yarn removing members 184 are preferably provided corresponding to the number of used yarn selection guides 27*a*–27*j*, the number of provided yarn removing members 184 may be less than the number of yarn selection guide 27*a*–27*j*.

Next, a further alternative embodiment of the yarn exchange mechanism will be described with reference to FIGS. 29 and 30. As illustrated, the yarn introduction member 6' is rotatably mounted to the distal end of a yarn introduction means 6. The yarn introduction member 6' is rotated in a direction of removing a yarn to remove the yarn from the yarn introduction member 6', while the yarn introduction member 6' is rotated in a direction of holding a yarn to hold the yarn for exchanging yarns.

For example, for exchanging a yarn 22 in the yarn selection guide 27*a* with a yarn in the yarn selection guide 27*e*, the yarn selection guide 27*a* is pivotally moved toward a guide bar 59*a*, causing an air cylinder 226 of a yarn introduction member actuator unit 222 corresponding to the yarn selection guide 27*a* to actuate to move a dog member 230 to an operative position, thus making ready for yarn exchange.

A yarn 22 supplied from a creel is held by the yarn introduction member 6' and passes between the base Y and the yarn selection guide 27*a* and the guide bar 59*a*. As the yarn introduction means 6 is rotated to cause a bearing 220 mounted to a plate 218 for pivotally moving the yarn introduction member 6' to abut to the dog member 230, the yarn introduction member 6' begins rotating toward a direction in which the yarn is removed. As the yarn introduction member 6' is rotated, the yarn 22*a* comes off the yarn introduction member 6'. The released yarn 22 is drawn back between the guide bar 59*a* and the base Y, comes in contact with the yarn selection guide 27*a* and held thereby.

As the yarn selection guide 27*a*, which has been pivotally moved to the guide bar 59*a*, is moved in the reverse direction to the base Y and accommodated therein, the released yarn 22, while held by the yarn selection guide 27*a*, is also accommodated in the base Y.

After the yarn introduction means 6 has passed the yarn removing position, the air cylinder 226 of the yarn introduction member actuator unit 222 is moved in a direction in which the dog member 230 is released from the operative position. Simultaneously with this, the yarn introduction member 6' is rotated in a direction of holding the yarn to return to its original position. The yarn introduction cover 59 is provided with a plurality of sensors 170 for detecting the yarn introduction means. The yarn introduction member actuator unit 222 is operated by a yarn introduction means detecting signal from the sensors 170 in accordance with a preset yarn exchanging order. While the sensors 170 are illustrated as being arranged on the yarn introduction cover 59, the sensors 170 may be arranged on the guide bar 59*a*. Also, in this case, similar operations can be performed by these components.

Next, as a yarn selection guide 27*e* for a yarn 22 to be wound is pivotally moved from the base Y to the guide bar 59*a*, the yarn 22 accommodated therein is held by the yarn selection guide 27*e* at the yarn exchange position. Next, as the yarn introduction member 6, which has been pivotally moved to return for holding the yarn, passes the position of the yarn selection guide 27*e*, the yarn 22 is wound around the warper drum A. The yarn selection guide 27*e*, which is free after passing the yarn 22, is pivotally moved to a standby position.

Figure 29:
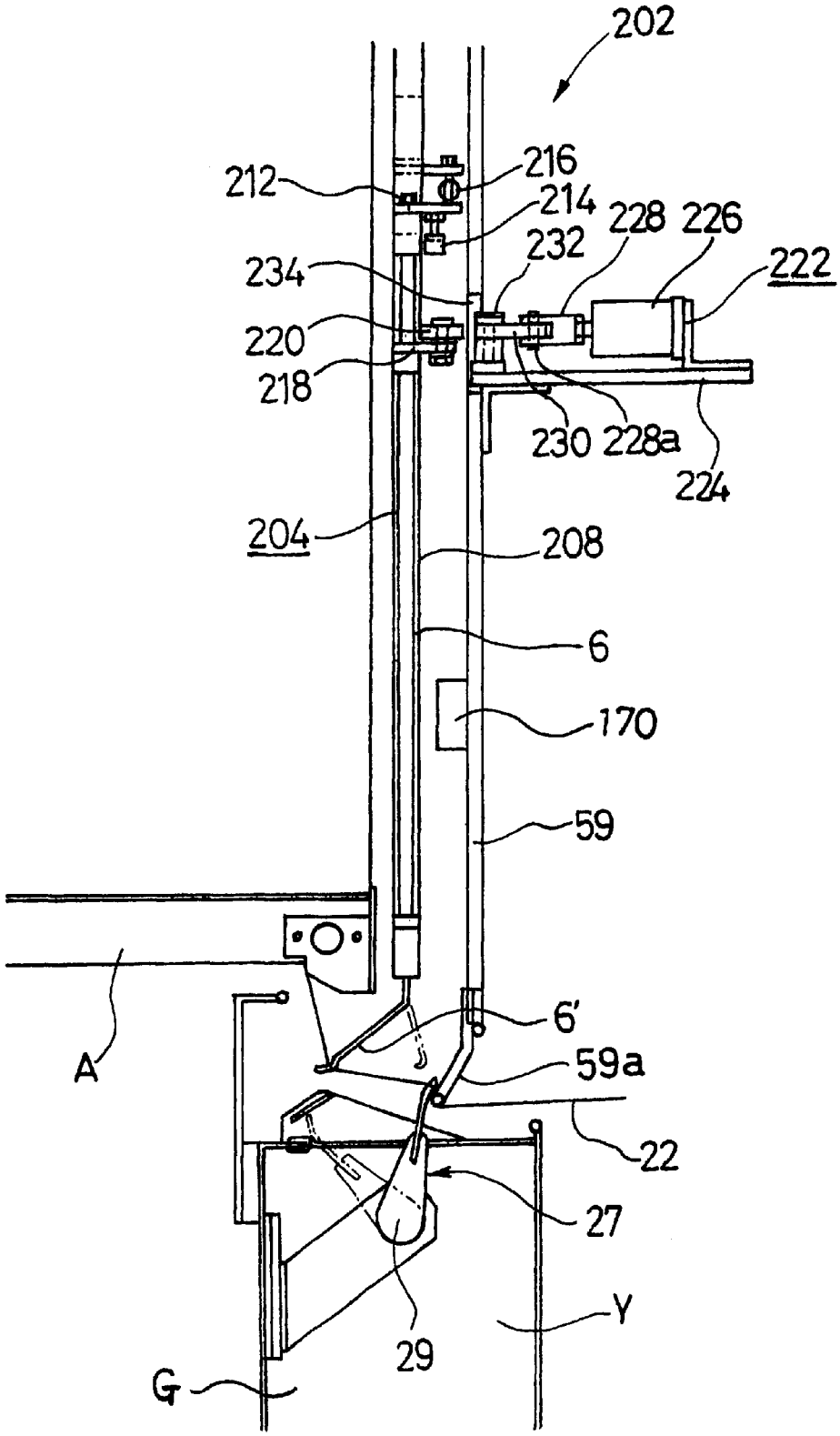
FIG. 29 is an enlarged lateral view of the yarn selection guide unit showing a state in which a yarn exchange operation is performed by a further yarn exchange mechanism.
Figure 30:
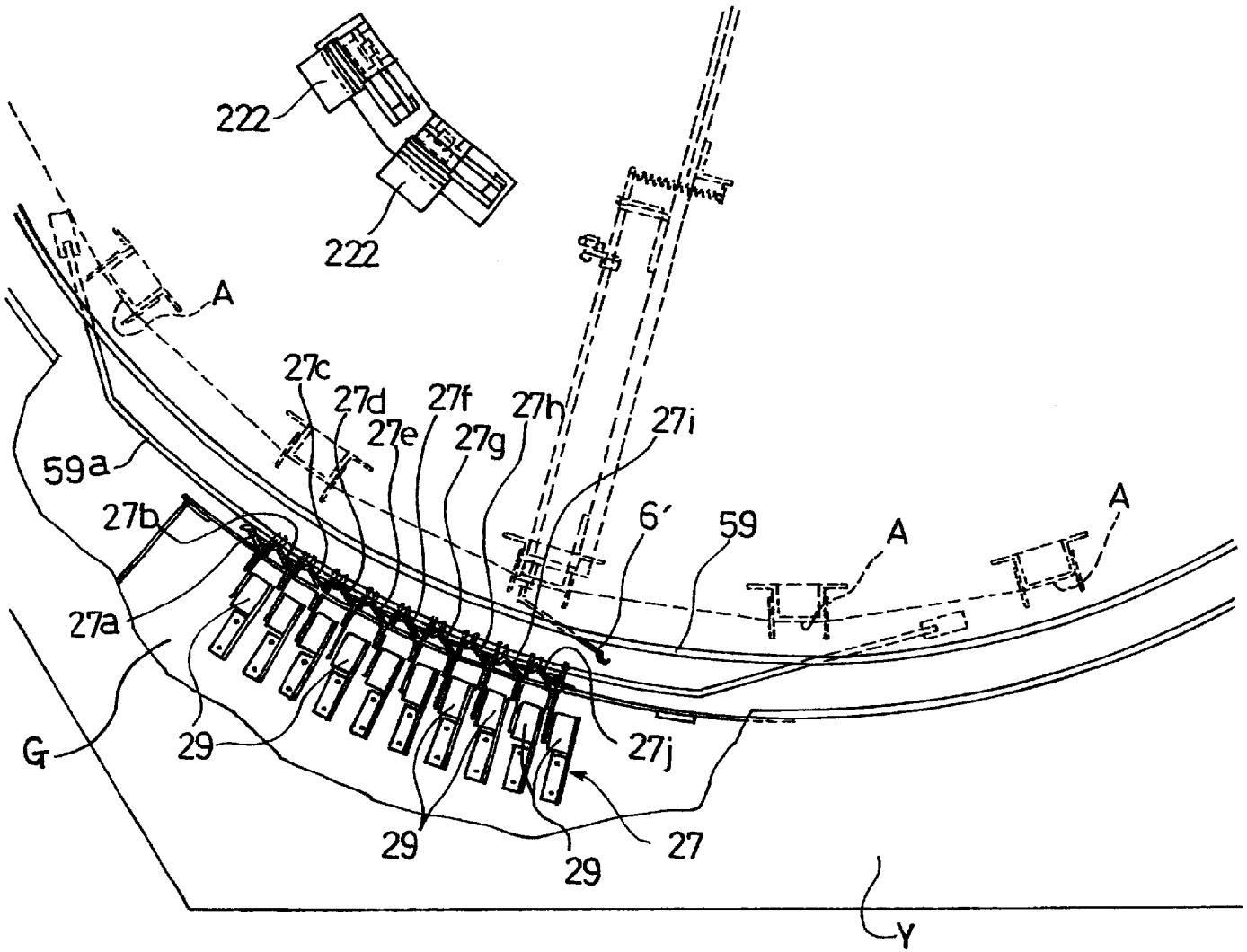
FIG. 30 is an enlarged view for showing the relationship between the yarn introduction means of FIG. 29 and the yarn selection guide unit.

The yarn exchange mechanism illustrated in FIG. 29 further includes a yarn introduction member actuator 202; a yarn introduction member assembly 204; a rotary holder 208; a pin plate 212; a stopper 214; a spring means 216; an air cylinder fixture 224; a joint member 228; and pins 228*a*, 232.

Figure 31:
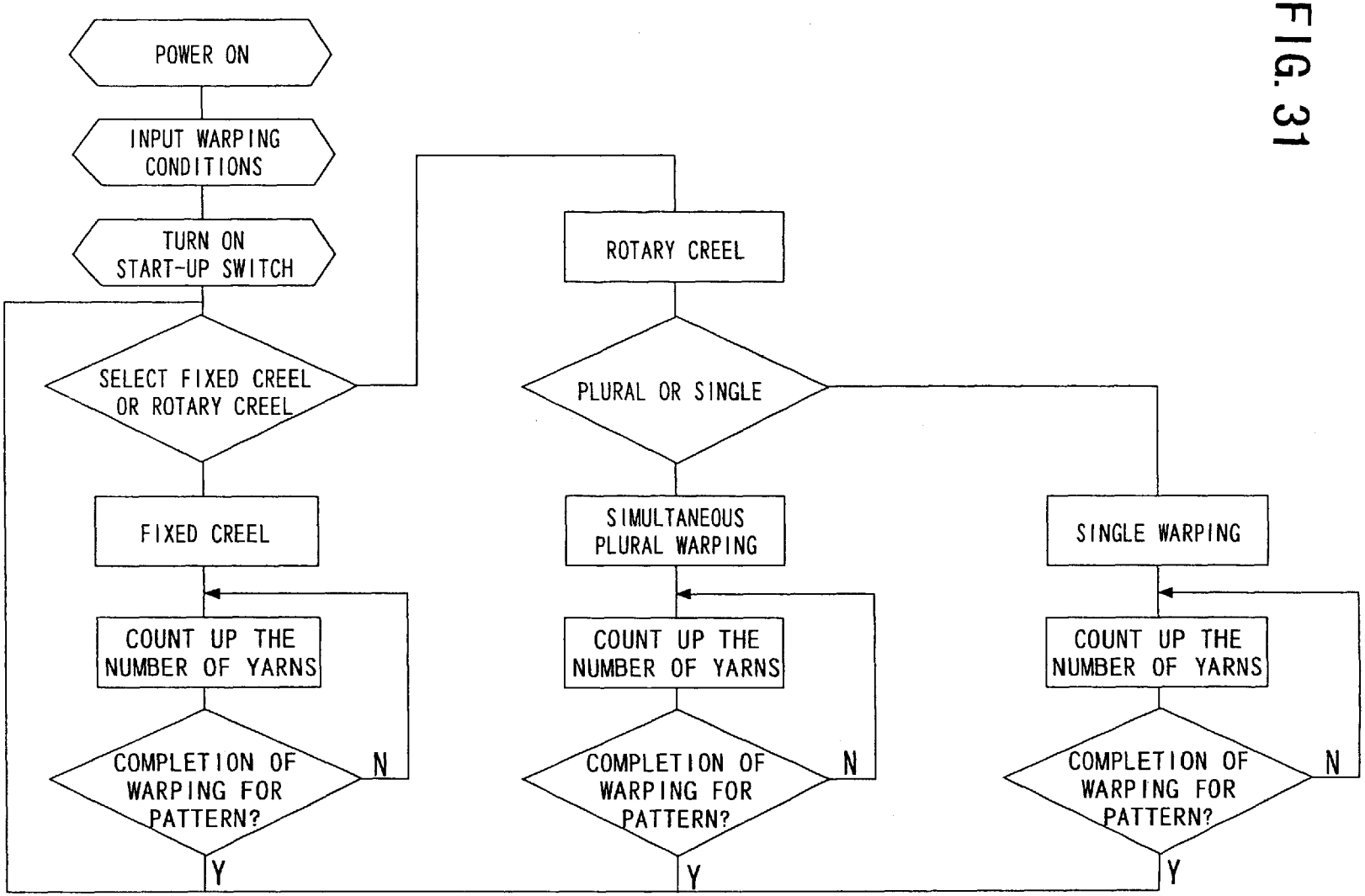
FIG. 31 is a flow chart illustrating a procedure for selectively using the fixed creel and the rotary creel.

Whether the fixed creel B or the rotary creel F is used for particular warping is automatically determined in accordance with preset pattern data (yarn order), so that the fixed creel B or the rotary creel F is selectively used in alternation. This procedure is described in greater detail with reference to FIG. 31. FIG. 31 is a flow chart illustrating the selective use of the fixed creel B and the rotary creel F.

The electronically controlled sample warper W is powered on, and a warping condition is inputted from the program setting unit 78 to provide the controller 79 with pattern data for which warping is performed. Then, a start-up switch is turned to cause a creel selection control unit in the controller 79 to select the fixed creel B or the rotary creel F.

When the fixed creel B is selected, the number of yarns 22*m* wound around the warper drum A by a single yarn introduction means 6 is counted, and the selection of a creel is again performed when the count reaches a predetermined number of yarns which has been set by the pattern data.

When the rotary creel F is selected by the creel selection control unit, another selection is subsequently made to simultaneous plural warping or single warping. Generally, the single warping may be performed using the fixed creel B, however, the single warping may also be performed by a single yarn introduction means of the rotary creel F as required. Therefore, it is necessary to select whether simultaneous plural warping or single warping is performed.

When the simultaneous plural warping is selected, a plurality of yarns are simultaneously wound around the warper drum A by a plurality of yarn introduction means of the rotary creel F. The number of wound yarns 22*n* is counted, and the selection of a creel is again performed when the count reaches a predetermined number of pattern yarns (or a predetermined number of plain yarns).

When the single warping is selected, a single yarn is wound around the warper drum A by a single yarn introduction means within a plurality of yarn introduction means of the rotary creel F. The number of wound yarns 22*n* is counted, and the selection of a creel is again performed when the count reaches a predetermined number of pattern yarns (or a predetermined number of plain yarns).

In this way, the pattern warping is performed in accordance with the preset pattern data (yarn order) by alternately selecting the fixed creel B and the rotary creel F. When a required number of yarns have been wound around the warper drum A, the pattern warping operation is terminated.

By employing such a novel yarn exchange mechanism, it is possible to eliminate or largely reduce yarn looseness, which has been inevitable in the prior art warper illustrated in FIGS. 34–38, and the requirement of yarn recovery time for removing the loosened yarn.

Figure 32:
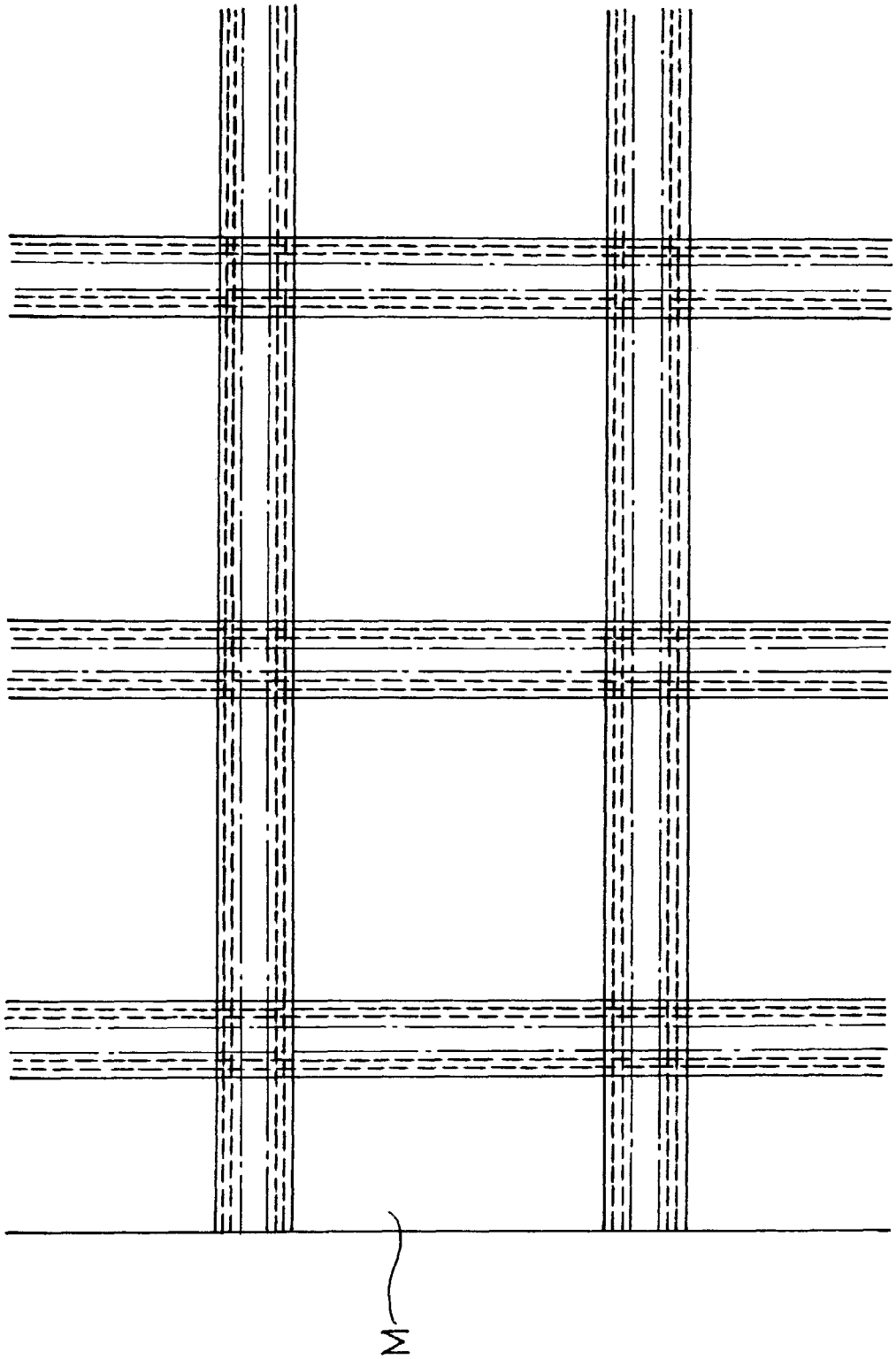
FIG. 32 is an explanatory diagram showing a cross-striped fabric which is warped using the electronically controlled sample warper of the present invention.

Next, description is made on the warping L (FIG. 33) of vertical yarns for weaving a fabric M of a cross-striped pattern illustrated in FIG. 32 using the foregoing configuration.

(1) The pattern warping is repeated for a total of 212 yarns which include 100 green yarns, two red yarns, six yellow yarns, two red yarns and 100 green yarns. Therefore, eight green yarns are set up in the rotary creel F, threaded through the yarn retainer 120 (serving also as an accumulator, an elastic force adjuster, and a yarn breakage detector) and the yarn return unit 118. Ends of the yarns are set one by one in yarn selection guides (27*a*–27*h*) having selection numbers No. 1–No. 8 of the sample warper W, respectively.

(2) For the fixed creel B, a green yarn, a red yarn and a yellow yarn are prepared, set up in the creel stand 102, and set one by one in yarn selection guides (27*a*–27*k*) having selection numbers No. 9, No. 10, No. 11 (27*k* is not illustrated), respectively.

(3) A program describing 100 green yarns (for example, designated A yarns), two red yarns (for example, designated B yarns), two yellow yarns (for example, C yarns), two red yarns (B yarns) and 100 green yarns (A yarns) is inputted to the control box 79. Also, warping conditions including a warping width, the number of yarns to be warped, and a warping length have been previously inputted.

(4) when a start-up switch is turned ON, the rotary creel F or the fixed creel B is determined by instructions of the controller 79. For the pattern warp mentioned above, the No. 1 yarn 22*a* is supplied to the No. 1 yarn introduction member 6*a*'; the No. 2 yarn 22*b* to the No. 2 yarn introduction member 6*b*'; the No. 3 yarn 22*c* to the No. 3 yarn introduction member 6*c*'; the No. 4 yarn 22*d* to the No. 4 yarn introduction member 6*d*'; the No. 5 yarn 22*e* to the No. 5 yarn introduction member 6*e*'; the No. 6 yarn 22*f* to the No. 6 yarn introduction member 6*f*'; the No. 7 yarn 22*g* to the No. 7 yarn introduction member 6*g*'; the No. 8 yarn 22*h* (green in this case) to the No. 8 yarn introduction member 6*h*'. Simultaneously with the supply of the yarns, the respective yarn introduction members 6*a*'–6*h*' and the rotary creel F are synchronized with each other, and the rotation and warping are started.

After the warping for 96 yarns is completed, the yarn 22*a* associated with the No. 1 yarn introduction member 6*a*' is accommodated in the No. 1 yarn selection guide 27*a*; the yarn 22*b* associated with the No. 2 yarn introduction member 6*b*' in the No. 2 yarn selection guide 27*b*; the yarn 22*c* associated with the No. 3 yarn introduction member 6*c*' in the No. 3 yarn selection guide 27*c*; the yarn 22*d* associated with the No. 4 yarn introduction member 6*d*' in the No. 4 yarn selection guide 27*d*; the yarn 22*e* associated with the No. 5 yarn introduction member 6*e*' in the No. 5 yarn selection guide 27*e*; the yarn 22*f* associated with the No. 6 yarn introduction member 6*f*' in the No. 6 yarn selection guide 27*f*; the yarn 22*g* associated with the No. 7 yarn introduction member 6*g*' in the No. 7 yarn selection guide 27*g*; and the yarn 22*h* associated with the No. 8 yarn introduction member 6*h*' in the No. 8 yarn selection guide 27*h* in order. Simultaneously, the synchronous operation of the rotary creel F is released, and the rotary creel F is stopped.

(5) Subsequently, the use of the fixed creel B is determined, causing the No. 9 yarn selection guide 27*i* to operate to supply the No. 9 yarn (green) 22*i* to the No. 1 yarn introduction member 6*a*', and warping is performed for four yarns. Simultaneously with the completion of the warping, the No. 9 yarn 22*i* is removed from the No. 1 yarn introduction member 6*a*', and accommodated in the No. 9 yarn selection guide 27*i*.

(6) Next, the No. 10 yarn selection guide 27*j* is operated to supply the No. 10 yarn (red) 22*j* to the No. 1 yarn introduction member 6*a*', and warping is performed for two yarns. Simultaneously with the completion of the warping, the No. 10 yarn 22*j* is removed from the No. 1 yarn introduction member 6*a*', and accommodated in the No. 10 yarn selection guide 27*j*.

(7) Next, the No. 11 yarn selection guide 27*k* is operated to supply the No. 11 yarn (yellow) 22*k* to the No. 1 yarn introduction member 6*a*', and warping is performed for six yarns. Simultaneously with the completion of the warping, the No. 11 yarn 22*k* is removed from the No. 1 yarn introduction member 6*a*', and accommodated in the No. 11 yarn selection guide 27*k*.

(8) Next, the No. 10 yarn selection guide 27*j* is operated to supply the No. 10 yarn (red) 22*j* to the No. 1 yarn introduction member 6*a*', and warping is performed for two yarns. Simultaneously with the completion of the warping, the No. 10 yarn 22*j* is removed from the No. 1 yarn introduction member 6*a*', and accommodated in the No. 10 yarn selection guide 27*j*.

(9) Subsequently, the use of the rotary creel F is determined, sequentially operating the No. 1 yarn selection guide 27*a* to supply the No. 1 yarn (green) 22*a* to the No. 1 yarn introduction member 6*a*'; operating the No. 2 yarn selection guide 27*b* to supply the No. 2 yarn (green) 22*b* to the No. 2 yarn introduction member 6*b*'; operating the No. 3 yarn selection guide 27*c* to supply the No. 3 yarn (green) 22*c* to the No. 3 yarn introduction member 6*c*'; operating the No. 4 yarn selection guide 27*d* to supply the No. 4 yarn (green) 22*d* to the No. 4 yarn introduction member 6*d*'; operating the No. 5 yarn selection guide 27*e* to supply the No. 5 yarn (green) 22*e* to the No. 5 yarn introduction member 6*e*'; operating the No. 6 yarn selection guide 27*f* to supply the No. 6 yarn (green) 22*f* to the No. 6 yarn introduction member 6*f*'; operating the No. 7 yarn selection guide 27*g* to supply the No. 7 yarn (green) 22*g* to the No. 7 yarn introduction member 6*g*'; operating the No. 8 yarn selection guide 27*h* to supply the No. 8 yarn (green) 22*h* to the No. 8 yarn introduction member 6*h*'. Simultaneously with the supply of the yarns, the respective yarn introduction members 6*a*'–6*h*' and the rotary creel F are rotated in synchronism to warp 96 yarns.

Upon completing the warping, the yarn 22*a* associated with the No. 1 yarn introduction member 6*a*' is accommodated in the No. 1 yarn selection guide 27*a*; the yarn 22*b* associated with the No. 2 yarn introduction member 6*b*' in the No. 2 yarn selection guide 27*b*; the yarn 22*c* associated with the No. 3 yarn introduction member 6*c*' in the No. 3 yarn selection guide 27*c*; the yarn 22*d* associated with the No. 4 yarn introduction member 6*d*' in the No. 4 yarn selection guide 27*d*; the yarn 22*e* associated with the No. 5 yarn introduction member 6*e*' in the No. 5 yarn selection guide 27*e*; the yarn 22*f* associated with the No. 6 yarn introduction member 6*f*' in the No. 6 yarn selection guide 27*f*; the yarn 22*g* associated with the No. 7 yarn introduction member 6*g*' in the No. 7 yarn selection guide 27*g*; and the yarn 22*h* associated with the No. 8 yarn introduction member 6*h*' in the No. 8 yarn selection guide 27*h* in order. Simultaneously, the synchronous operation of the rotary creel F is released, and the rotary creel F is stopped.

(10) Subsequently, the use of the fixed creel B is determined, operating the No. 9 yarn selection guide 27*i* to supply the No. 9 yarn (green) 22*i* to the No. 1 yarn introduction member 6*a*', and warping is performed for four yarns. Simultaneously with the completion of the warping, the No. 9 yarn 22*i* is removed from the No. 1 yarn introduction member 6*a*', and accommodated in the No. 9 yarn selection guide 27*i*.

Thus, the warping for one repeat (one pattern portion) has been completed, and subsequently, the steps (1)–(10) may be repeated the number of times equal to the number of yarns to be warped. It should be noted that in the foregoing description, the yarns 22*a*–22*k* are distinguished merely for convenience of description and are not illustrated. Also, the illustration of the yarn selection guide 27*k* is omitted.

It goes without saying that in the foregoing warping operation, respective units associated with the sample warper of the present invention are constantly controlled corresponding to the use of the rotary creel and the use of the fixed creel with respect to the counting of the number of times the warping is performed, counting of the number of shedded yarns, and movements of the conveyor, so that the warping operation is advanced properly.

It will be appreciated from the foregoing description that the present invention has an effect of extremely efficiently performing a warping operation, which requires both plain warping and pattern warping, with a reduced warping time.

What is claimed is:

1. A rotary creel comprising:

a base;

a spindle shaft rotatably mounted to said base and protruding forward from said base;

a plurality of bobbins mounted to a protruded portion of said spindle shaft through bobbin holders; and a guide plate mounted in a distal end portion of said spindle shaft through a guide arm so as to be positioned in front of said bobbins, wherein when said spindle shaft is rotated, a plurality of yarns wound around said plurality of bobbins can be rotated and simultaneously supplied through said guide plate.

2. A rotary creel according to claim 1, further comprising a yarn return unit attached to said distal end portion of said spindle shaft through a front holder, wherein said guide arm is attached to said front holder, and said guide plate is positioned in front of said yarn return unit, so that a plurality of yarns wound around said plurality of bobbins can be rotated and simultaneously supplied through said yarn return unit and said guide plate.

3. A rotary creel according to claim 2, further comprising a yarn retainer attached to said front holder, wherein said guide plate and said yarn return unit are positioned in front of said yarn retainer, so that a plurality of yarns wound around said plurality of bobbins can be rotated and simultaneously supplied through said yarn retainer, said yarn return unit and said guide plate.

4. A rotary creel according to claim 2, wherein said yarn return unit has means for applying tensile force to said yarn in warping, pulling said yarn loosened when yarn exchanging back toward said rotary creel, and applying force to said yarn accommodated in said yarn selection guide so as to always keep said yarn in a state of tension.

5. A rotary creel according to claim 3, wherein said yarn return unit has means for applying tensile force to said yarn in warping, pulling said yarn loosened when yarn exchanging back toward said rotary creel, and applying force to said yarn accommodated in said yarn selection guide so as to always keep said yarn in a state of tension.

6. A rotary creel according to claim 4, wherein said means is provided so that said force applied to said yarn is adjustable.

7. A rotary creel according to claim 5, wherein said means is provided so that said force applied to said yarn is adjustable.

* * * * *